US006586872B2

(12) United States Patent
Shibata

(10) Patent No.: US 6,586,872 B2
(45) **Date of Patent: *Jul. 1, 2003**

(54) ELECTRON EMISSION SOURCE, METHOD AND IMAGE-FORMING APPARATUS, WITH ENHANCED OUTPUT AND DURABILITY

(75) Inventor: Masaaki Shibata, Ninomiya-machi (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/143,388

(22) Filed: Aug. 28, 1998

(65) Prior Publication Data

US 2002/0000767 A1 Jan. 3, 2002

(30) Foreign Application Priority Data

Sep. 3, 1997 (JP) ..... 9-238278

(51) Int. Cl.[7] ..... H01J 1/30
(52) U.S. Cl. ..... 313/495; 313/310; 445/24
(58) Field of Search ..... 313/310, 311, 313/346 R, 346 DC, 355, 495, 505, 506; 445/24, 35, 49, 50, 51

(56) References Cited

U.S. PATENT DOCUMENTS

| | | | | |
|---|---|---|---|---|
| 4,954,744 A | | 9/1990 | Suzuki et al. | 313/336 |
| 5,654,607 A | * | 8/1997 | Yamaguchi et al. | 313/495 |
| 5,763,997 A | * | 6/1998 | Kumar | 313/495 |
| 5,986,389 A | * | 11/1999 | Tsukamoto | 313/310 |
| 5,990,605 A | * | 11/1999 | Yoshikawa et al. | 313/310 |
| 6,184,610 B1 | * | 2/2001 | Shibata et al. | 313/309 |
| 6,246,168 B1 | * | 6/2001 | Kishi et al. | 313/495 |

FOREIGN PATENT DOCUMENTS

| | | | |
|---|---|---|---|
| EP | 0 660 357 A1 | 6/1995 | H01J/1/30 |
| EP | 0 696 044 A2 | 2/1996 | |
| EP | 0 701 265 A1 | 3/1996 | H01J/1/30 |
| EP | 0 757 371 A2 | 2/1997 | |
| JP | 7-141982 | 6/1995 | H01J/1/30 |
| JP | 7-235255 | 9/1995 | |
| JP | 8-264112 | 10/1996 | |
| JP | 8-321254 | 12/1996 | |
| JP | 8-329828 | 12/1996 | H01J/1/30 |
| JP | 9-102267 | 4/1997 | |

OTHER PUBLICATIONS

Patent Abstracts of Japan, vol. 96, No. 011, Nov. 29, 1996 (with respect to JP 8–180796 Jul. 12, 1996).

(List continued on next page.)

*Primary Examiner*—Vip Patel
*Assistant Examiner*—Joseph Williams
(74) *Attorney, Agent, or Firm*—Fitzpatrick, Cella, Harper & Scinto

(57) ABSTRACT

An electron-emitting device comprising, on a substrate, a pair of electrodes, an electroconductive film having a gap in part, connected to the pair of electrodes, a member comprising a principal component of carbon, provided in the gap portion while being connected to the electroconductive film, and a metallic oxide comprising at least one element selected from the group consisting of nickel, iron, and cobalt, between the member comprising the principal component of carbon and the substrate.

15 Claims, 17 Drawing Sheets

OTHER PUBLICATIONS

Patent Abstracts of Japan, vol. 96, No. 006, Jun. 28, 1996 (with respect to JP 8–055563 of Feb. 27, 1996).

"Physical Properties Of Thin–Film Field Emission Cathodes With Molybdenum Cones", C.A. Spindt, et al., Journal of Applied Physics, vol. 47, No. 12, pp. 5248–5263 (Dec. 1976).

"Operation Of Tunnel–Emission Devices", Journal of Applied Physics, C.A. Mead, vol. 32, No. 4, pp. 646–652 (Apr. 1961).

"The Emission Of Hot Electrons And The Field Emission Of Electrons From Tin Oxide", M.I. Elinson, et al., Radio Engineering and Electronic Physics, No. 7, pp. 1290–1296 (Jul. 1965).

"Strong Electron Emission From Patterned Tin–Indium Oxide Thin Films", Hartwell, et al., *International Electron Devices Meeting*, Washington, D.C. pp. 519–521 (1975).

"Electrical Conduction And Electron Emission Of Discontinuous Thin Films", G. Dittmer, *Thin Solid Films*, vol. 9, pp. 317–328 (1972).

"Electroforming And Electron Emission Of Carbon Thin Films", Hisashi Araki, et al., Journal of the Vacuum Society of Japan, vol. 26, No. 1, pp. 22–29 (1981).

"Field Emission", W.P. Dyke, et al., Advances in Electronics and Electron Physics, vol. 8, pp. 89–185 (1956).

* cited by examiner

ELECTRON EMISSION SOURCE, METHOD AND IMAGE-FORMING APPARATUS, WITH ENHANCED OUTPUT AND DURABILITY

BACKGROUND OF THE INVENTION

1. Field of the Invention

The present invention relates to an electron-emitting device, an electron source and an image-forming apparatus using it, and production methods thereof.

2. Related Background Art

The conventionally known electron-emitting devices are roughly classified under two types as a thermionic cathode and as a cold-cathode. The cold-cathode emission sources include field emission type (hereinafter referred to as "FE type") devices, metal/insulator/metal type (hereinafter referred to as "MIM type") devices, surface conduction electron-emitting devices, and so on.

Examples of the FE type devices known include those disclosed in W. P. Dyke & W. W. Dolan, "Field emission", Advance in Electron Physics, 8, 89 (1956) or in C. A. Spindt, "Physical Properties of thin-film field emission cathodes with molybdenum cones", J. Appl. Phys., 47, 5248 (1976), and so on.

Examples of the MIM type devices known include those disclosed in C. A. Mead, "Operation of Tunnel-Emission Devices", J. Appl. Phys., 32, 646 (1961), and so on.

Examples of the surface conduction electron-emitting devices include those disclosed in M. I. Elinson, Radio Eng. Electron Phys., 10, 1290 (1965), and so on.

The surface conduction electron-emitting devices utilize such a phenomenon that electron emission occurs when electric current is allowed to flow in parallel to the surface in a thin film of a small area formed on a substrate. Examples of the surface conduction electron-emitting devices reported heretofore include those using a thin film of $SnO_2$ by Elinson cited above, those using a thin film of Au [G. Ditmmer: "Thin Solid Films", 9, 317 (1972)], those using a thin film of $In_2O_3/SnO_2$ [M. Hartwell and C. G. Fonsted: "IEEE Trans. ED Conf.," 519, (1975)], those using a thin film of carbon [Hisashi Araki et al.: Shinku (Vacuum), Vol. 26, No. 1, p22 (1983)], and so on.

A typical device configuration of these surface conduction electron-emitting devices is the device structure of M. Hartwell cited above, which is shown in FIG. 18. In the same drawing, numeral 1 designates an electrically insulative substrate. Numeral 4 denotes an electrically conductive, thin film, which is, for example, a thin film of a metallic oxide formed in an H-shaped pattern by sputtering and in which an electron-emitting region 5 is formed by energization operation called forming described hereinafter. In the drawing the gap L between the device electrodes is set to 0.5–1 mm and the width W' to 0.1 mm.

In these conventional surface conduction electron-emitting devices, it was common practice to preliminarily subject the conductive film 4 to the energization operation called forming, prior to execution of electron emission, thereby forming the electron-emitting region 5. Namely, the forming is an operation for applying a dc voltage or a very slowly increasing voltage, for example at the increasing rate of about 1 V/min, to the both ends of the conductive film 4 to locally break, deform, or deteriorate the conductive film, thereby forming the electron-emitting region 5 in an electrically high resistant state. In the electron-emitting region 5 a fissure is formed in part of the conductive film 4 and electrons are emitted from near the fissure. The surface conduction electron-emitting device experiencing the aforementioned forming operation is arranged so that electrons are emitted from the above-stated electron-emitting region 5 when the current flows in the device with application of the voltage to the above-described conductive film 4.

On the other hand, in the case of another surface conduction electron-emitting device, for example, as disclosed in Japanese Laid-open Patent Application No. 7-235255, the device having experienced the forming is sometimes subject to a treatment called an activation operation. The activation operation is a step by which significant change appears in the device current If and in the emission current Ie.

The activation step can be performed by repetitively applying pulse voltage to the device, as in the case of the forming operation, under an ambience containing an organic substance. This operation causes carbon or a carbon compound from the organic substance existing in the ambience to be deposited at least on the electron-emitting region of the device, so as to achieve outstanding change in the device current If and in the emission current Ie, thereby achieving better electron emission characteristics.

An image-forming apparatus can be constructed by using an electron source substrate having a plurality of such electron-emitting devices as described above and combining it with an image-forming member comprised of a fluorescent member and other members.

The image-forming apparatus including the displays etc., however, has been and is required to have higher performance according to quick steps to multimedia society with recent increase in sophistication of information. Namely, requirements are increase in the size of screen, decrease in power, increase in definition, enhancement of quality, decrease in space, etc. of the display devices.

With the aforementioned electron-emitting devices, there is thus a desire for the technology for keeping stable electron emission characteristics in still higher efficiency and for longer time so as to permit the image-forming apparatus employing the electron-emitting devices to provide bright display images on a stable basis.

The efficiency herein means a current ratio of electric current emitted into vacuum (hereinafter referred to as emission current Ie) to electric current flowing (hereinafter referred to as device current If), when the voltage is applied between a pair of opposed device electrodes of the surface conduction electron-emitting device.

It is, therefore, desirable that the device current If be as small as possible and that the emission current Ie be as large as possible.

If the highly efficient electron emission characteristics can be stably controlled over long time, we will be able to realize a bright and high-definition image-forming apparatus of low power, for example a flat television, in the case of the image-forming apparatus, for example, using the fluorescent member as an image-forming member.

It is, however, the present status of the aforementioned M. Hartwell electron-emitting device that the device is not always satisfactory yet as to the stable electron emission characteristics and the electron emission efficiency and that it is very difficult to provide a high-luminance image-forming apparatus with excellent operation stability using it.

It is necessary for use in such application that sufficient emission current Ie be obtained by a practical voltage (for example, 10 V–20 V), that the emission current Ie and device current If not vary largely during driving, and that the emission current Ie and device current If not be degraded over long periods of use. The conventional surface conduction electron-emitting device of M. Hartwell had the following problem, however.

As shown in FIG. 18, the surface conduction electron-emitting device of M. Hartwell has the electron-emitting region 5 nearly perpendicular to the direction of application of voltage.

SUMMARY OF THE INVENTION

An object of the present invention is to provide an electron-emitting device having good electron emission characteristics and an electron source using it and to provide a high-luminance image-forming apparatus using the electron-emitting devices.

Another object of the present invention is to provide an electron-emitting device demonstrating minimized change in the electron-emitting characteristics and an electron source using it and to provide an image-forming apparatus capable of maintaining high luminance over a longer period, using the electron-emitting devices.

The present invention provides an electron-emitting device comprising, on a substrate, a pair of electrodes, an electroconductive film having a gap in part, connected to said pair of electrodes, a member comprising a principal component of carbon, provided in the gap portion while being connected to the electroconductive film, and a metallic oxide comprising at least one element selected from the group consisting of nickel, iron, and cobalt, between said member comprising the principal component of carbon and said substrate.

The present invention also provides an electron-emitting device comprising, on a substrate, a pair of electrodes, an electroconductive film having a gap in part, connected to said pair of electrodes, and a member comprising carbon having an orientation of a layer structure substantially parallel to a surface of the substrate, said member being provided in the gap portion while being connected to the electroconductive film.

The present invention provides an electron source for emitting electrons according to an input signal, wherein a plurality of the electron-emitting devices as set forth are arrayed on a substrate.

The present invention also provides an image-forming apparatus for forming an image, based on an input signal, said image-forming apparatus comprising an image-forming member and the electron source as set forth.

The present invention provides a production method of electron-emitting device comprising a step of forming an electroconductive film on a film comprising a metallic oxide comprising at least one element selected from the group consisting of nickel, iron, and cobalt, provided between a pair of electrodes on a substrate, a step of forming a gap in part of the electroconductive film, and a step of forming a member comprising a principal component of carbon in a connected state to the electroconductive film, in the gap portion.

DETAILED DESCRIPTION OF THE PREFERRED EMBODIMENTS

Figure 1A:
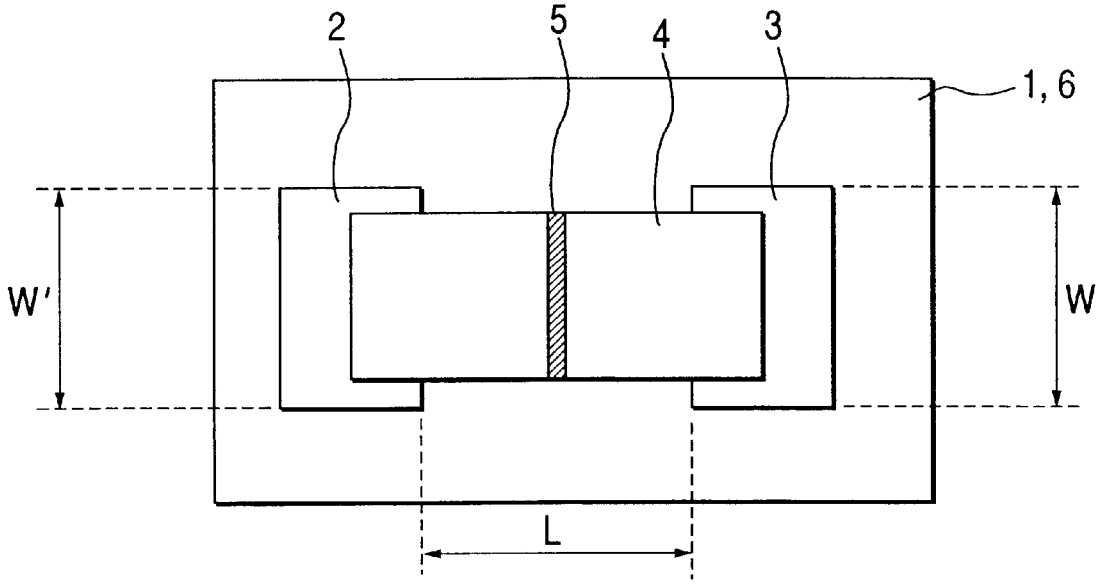
FIG. 1A and FIG. 1B are diagrams to show the structure of a basic surface conduction electron-emitting device according to the present invention.

A feature of the electron-emitting device of the present invention is that the device has, on a substrate, a pair of electrodes, an electroconductive film having a gap in part, the film being connected to the pair of electrodes, a member containing a principal component of carbon, the member being provided in the gap portion while being connected to the electroconductive film, and a metallic oxide containing at least one element out of nickel, iron, and cobalt, the metallic oxide being provided between the substrate and the member containing the principal component of carbon.

The metallic oxide stated above is preferably at least one oxide out of nickel oxide, iron oxide, and cobalt oxide, the metallic oxide is provided in the form of a film, for example, on the substrate, and the film also involves a fine particle film or an island-shaped film. The above-stated film may be a film in which a matrix having a principal component of silica or the like contains the at least one metallic oxide out of nickel oxide, iron oxide, and cobalt oxide.

Another feature of the electron-emitting device of the present invention is that the device has, on a substrate, a pair of electrodes, an electroconductive film having a gap in part, the film being connected to the pair of electrodes, and a member containing carbon having an orientation of layer structure substantially parallel to a surface of the substrate, the member being provided in the gap portion while being connected to the electroconductive film.

Further, the present invention involves a feature that the electron-emitting device described above is a surface conduction electron-emitting device.

A feature of the production method of electron-emitting device according to the present invention is that the method has a step of forming an electroconductive film on a film containing a metallic oxide including at least one element of nickel, iron, and cobalt, provided between a pair of electrodes on a substrate, a step of forming a gap in a part of the electroconductive film, and a step of forming a member containing a principal component of carbon, in the gap portion while establishing connection thereof to the electroconductive film.

In this case, the step of forming the gap in the electroconductive film is preferably carried out by applying a voltage to the electroconductive film and the step of forming the member containing the principal component of carbon in the gap portion is preferably carried out by applying a voltage to the electroconductive film in an ambience in which a carbon compound exists.

The aforementioned film containing the metallic oxide may be formed prior to formation of the pair of electrodes on the substrate or may be formed between the pair of electrodes after formation of the pair of electrodes on the substrate.

The formation of the film containing the metallic oxide is preferably carried out by a step of applying a solution of an organometallic compound containing at least one element out of nickel, iron, and cobalt to form an organometallic compound film and a step of baking the organometallic compound film, wherein the step of forming the aforementioned organometallic compound film can be carried out using a spin coat method, an aerocoat method, a dipping method, a printing method, an ink jet method, and so on. The formation of the film containing the metallic oxide may also be carried out by a step of forming a film containing at least one metal out of nickel, iron, and cobalt and a step of oxidizing the film.

Further, the present invention involves the electron source, and the image-forming apparatus such as the display devices.

The electron source of the present invention is an electron source for emitting electrons in response to an input signal, in which a plurality of electron-emitting devices as described above are placed on a substrate, and preferably, the electron source has a plurality of rows of electron-emitting devices, both ends of the individual devices being connected to wires, and also has a modulating means. In another preferred embodiment, the electron source is characterized in that a plurality of electron-emitting devices, pairs of electrodes of the electron-emitting devices being connected to m X-directional wires and to n Y-directional wires electrically insulated from the X-directional wires, are arrayed on a substrate.

The image-forming apparatus of the present invention is an apparatus for forming an image, based on an input signal, which is characterized by being comprised of at least an image-forming member and the above-stated electron source.

The present invention can realize the electron-emitting device capable of maintaining stable electron emission characteristics over long time.

Further, the present invention can form stable and good images over long time.

In the electron-emitting device of the present invention the electron-emitting region is located near the gap portion of the conductive film. Wherein, the gap portion is typically one formed to separate into two the conductive film. While the two separated conductive film sections may be connected partially.

The preferred embodiments of the present invention will be described below.

First described is the basic structure of the surface conduction electron-emitting device according to the present invention.

Figure 1B:
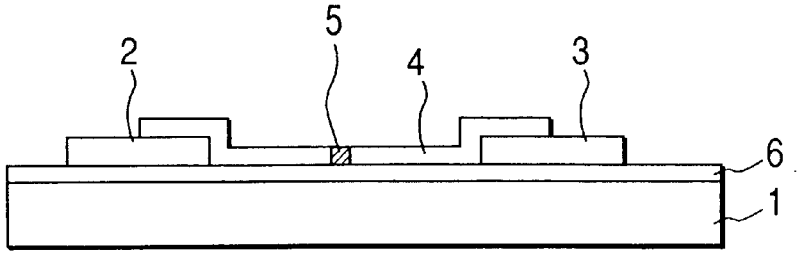
Figure 2A:
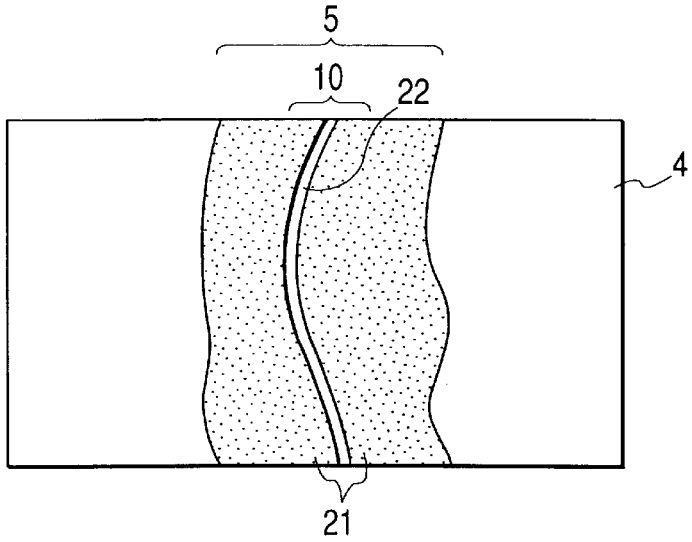
FIG. 2A, FIG. 2B, FIG. 2C, and FIG. 2D are enlarged views to show the structure of a basic surface conduction electron-emitting device according to the present invention.
Figure 2B:
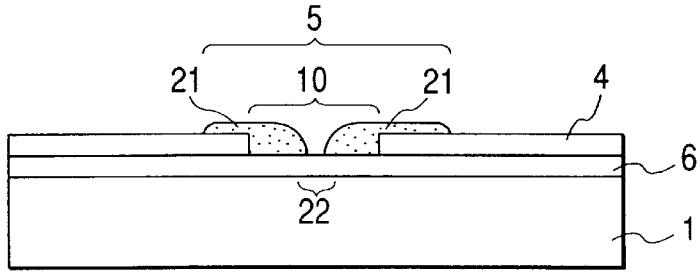

FIG. 1A and FIG. 1B are a plan view and a sectional view, respectively, to show the structure of a basic plane type surface conduction electron-emitting device according to the present invention. FIG. 2A and FIG. 2B are a plan view and a sectional view, respectively, to schematically show the enlarged structure of the vicinity of the electron-emitting region of the surface conduction electron-emitting device according to the present invention. The fundamental structure of the device according to the present invention will be described referring to FIGS. 1A and 1B and FIGS. 2A to 2D.

In FIGS. 1A and 1B, reference numeral 1 designates a substrate, 2 and 3 device electrodes, 4 an electroconductive film, 5 an electron-emitting region, and 6 a metallic oxide film.

In FIGS. 2A to 2D, numeral 1 designates a substrate, 4 an electroconductive film, 5 an electron-emitting region, 6 a metallic oxide film, 10 a gap portion of the electroconductive film 4 and 21 a deposit including a principal component of carbon, 22 a gap portion of the deposit 21, which is narrower than the gap 10.

The substrate 1 may be made of material selected from glass substrates including those of quartz glass, glass with a reduced content of impurities such as Na, and soda lime glass, a glass substrate in which $SiO_2$ is deposited on soda lime glass by sputtering, ceramics such as alumina, and so on.

A material for use in producing the opposed device electrodes 2, 3 may be any material that has electrically conductive nature, and may be selected, for example, from metals such as Ni, Cr, Au, Mo, W, Pt, Ti, Al, Cu, or Pd, or alloys thereof; print conductors comprised of a metal or a metallic oxide such as Pd, Ag, Au, $RuO_2$, or Pd—Ag, glass, etc.; transparent conductive materials such as $In_2O_3$—$SnO_2$; semiconductive/conductive materials such as polysilicon; and so on.

The device electrode gap L, the device electrode length W, the shape of the conductive film 4, etc. are properly designed according to an application form of this device etc.; for example, in the case of a display device for television or the like described hereinafter, the pixel size is designed corresponding to the screen size; particularly, a high-definition television necessitates small pixel size and high definition. In order to achieve sufficient luminance in the limited size of electron-emitting device, they are designed so as to obtain sufficient emission current.

The device electrode gap L is from several ten nm to several hundred μm, which is set according to the photolithography technology being the basis of the production method of device electrode, i.e., performance of exposure apparatus, an etching method, etc., and the voltage applied between the device electrodes, and which is preferably several μm to several ten μm.

The device electrode length W and the thickness d of the device electrodes 2, 3 are properly designed depending upon a resistance of the electrodes, the aforementioned connection to the X- and Y-wires, and the matter concerning placement of many electron sources provided; normally, the length W of the device electrodes is several μm to several hundred μm and the thickness d of the device electrodes 2, 3 is several nm to several μm.

In addition to the structure shown in FIG. 1A and FIG. 1B, the device can also be constructed in another structure in which the metallic oxide film 6, conductive film 4, and opposed device electrodes, 2, 3 are stacked in the named order on the substrate 1 or in another structure in which the opposed device electrodes 2, 3, the metallic oxide film 6, and conductive film 4 are stacked in the named order on the substrate 1.

The conductive film 4 is preferably a fine particle film comprised of fine particles in order to achieve good electron emission characteristics. The thickness of the film 4 is properly set taking account of step coverage over the device electrodes 2, 3, the resistance between the device electrodes 2, 3, forming conditions described hereinafter, and so on.

In general, thermal stability of the conductive film 4 may dominate the lifetime of the electron emission characteristics, and therefore, a material having a higher melting point is desirably used as a material for the conductive film 4. Normally, the higher the melting point of the conductive film 4, the more difficult the energization forming described hereinafter; thus higher power becomes necessary for formation of the electron-emitting region, however.

Further, depending upon the form of the resultant electron-emitting region, there could arise a problem in the electron emission characteristics, for example increase in the applied voltage enough for electron emission (threshold voltage), in some cases.

The present invention does not require a material having a particularly high melting point as a material for the conductive film 4, and permits us to select a material and a form capable of forming a good electron-emitting region by relatively low forming power.

An example of a preferred material satisfying the above conditions is an electroconductive material such as Ni, Au, PdO, Pd, or Pt, having such a thickness that Rs (sheet resistance) is in the range of $10^2$ to $10^7$ Ω/□. Rs is a value appearing in an equation of R=Rs (l/w) where the resistance R is measured in the longitudinal direction of a thin film having the thickness t, the width w, and the length l, so that Rs=ρ/t where ρ is the resistivity. The thickness to indicate the above resistance is in the range of approximately 5 nm to 50 nm, and in this thickness range, the thin film of each material has the form of fine particle film.

The fine particle film stated herein is a film as an assemblage of plural fine particles and the microstructure thereof is a state in which the fine particles are dispersed separately or a state in which the fine particles are adjacent to each other or overlapping each other (including a state in which some fine particles gather to form the island-shaped structure as a whole).

The grain sizes of the fine particles are in the range of several hundred pm to several hundred nm, preferably in the range of 1 nm to 20 nm.

Among the materials exemplified above, PdO is a suitable material because a thin film of PdO can be formed readily by baking of an organic Pd compound in the atmosphere, because it is a semiconductor having a relatively low electric conductivity and a wide process margin of thickness for obtaining the resistance Rs in the aforementioned range, because the film resistance can be lowered by readily reducing it to the metal Pd after formation of the electron-emitting region, and so on. It is, however, noted that the effect of the present invention can also be achieved by the other materials without having to be limited to PdO nor to the above exemplified materials.

The electron-emitting region 5 is a high resistance region, includes a gap portion 10, formed in a part of the conductive film 4. The electron-emitting region 5 is made of a deposit 21 having the principal component of carbon, as shown in FIGS. 2A to 2D, through the activation step described hereinafter. And, the deposit 21 has a gap 22 of which width is narrower than the gap 10 formed at a part of the conductive film 4. The conductive film 4 may be continuous partially across the gap.

The deposit 21 having the principal component of carbon is comprised mainly of graphite-like carbon, and the deposit 21 may contain some or all of the elements constituting the conductive film 4 and the metallic oxide film 6.

In the gap 10, the deposit 21 containing the principal component of carbon, which forms the electron-emitting region 5, is in contact with the metallic oxide film 6 formed on the surface of substrate 1. In the present invention, though the details will be described hereinafter, the element of nickel, cobalt, or iron included in the metallic oxide film 6 exerts the catalytic action during the carbon deposition process from the organic substance in the activation step, so that graphite-like carbon with good crystallinity is readily deposited in the orientation of the layer structure over the metallic oxide film 6.

The metallic oxide film 6 may be made of not only an oxide of a single metal element selected from nickel oxide, cobalt oxide, and iron oxide, but also a mixture of these oxides, or a composite oxide including a plurality of metal elements out of these.

In the present invention, the objective is that the element of nickel, cobalt, or iron having the catalytic action associated with the deposition of carbon is placed at the interface where the electron-emitting region 5 is in contact with the substrate, as described previously, and thus the metallic oxide film 6 can be selected from various forms.

Figure 3A:
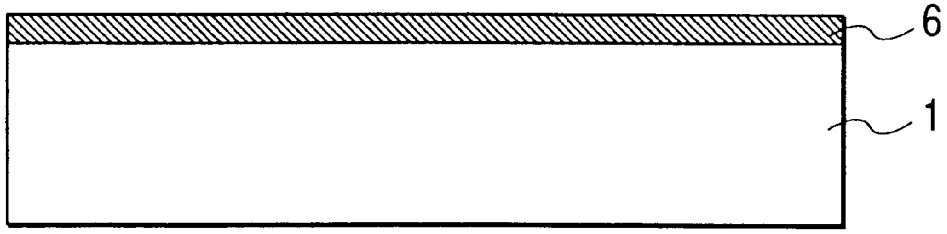
FIG. 3A and FIG. 3B are diagrams for explaining the structure of a basic surface conduction electron-emitting device according to the present invention.
Figure 3B:
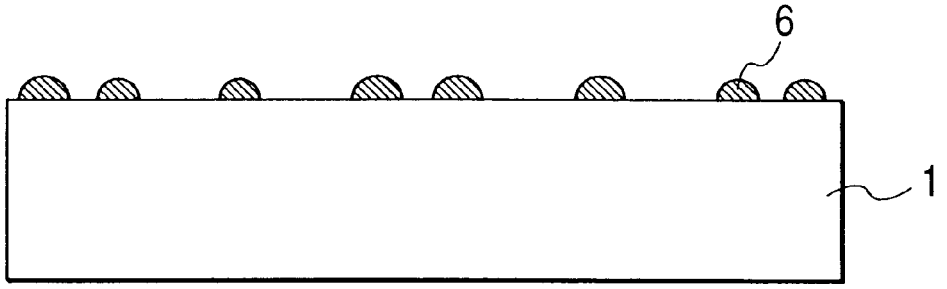

FIG. 3A and FIG. 3B illustrate examples of forms of the metallic oxide film 6 that can be preferably employed in the present invention. FIG. 3A illustrates an example using a continuous film as the metallic oxide film 6 and FIG. 3B an example using a fine particle film or an island-shaped film as the metallic oxide film 6.

The metallic oxide film 6 might be reduced to the metal if it is heated in a contact state with carbon in vacuum.

With use of the continuous film shown in FIG. 3A, the metal created by reduction of the oxide could form a conductive path immediately below the electron-emitting region 5 in certain cases. In such cases, when the voltage is applied between the device electrodes, excessive leak current would flow as the device current If, so as to considerably lowers the electron emission efficiency. This is not preferred.

Figure 2C:
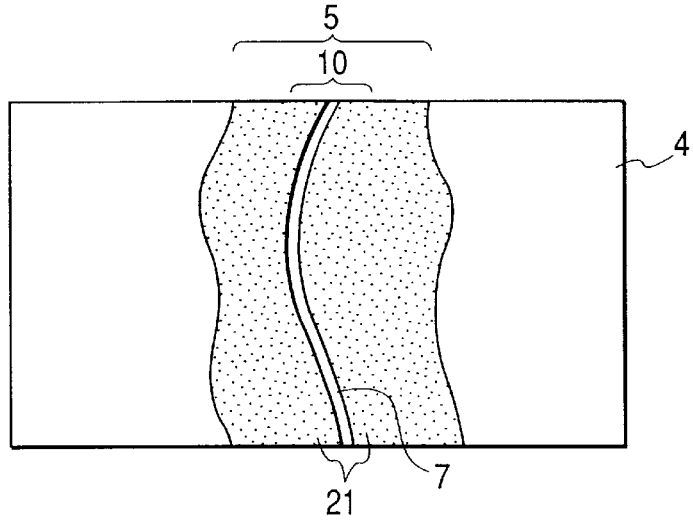
Figure 2D:
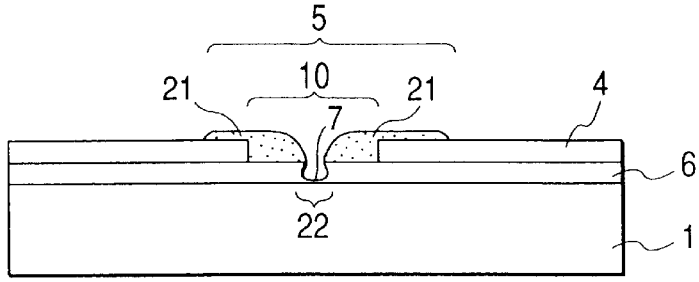

If the vapor pressure of the metal created by reduction is high enough, the metal atoms will desorb into vacuum (so as to form a groove 7 in the metallic oxide film 6 as shown in FIGS. 2C and 2D) and no conductive path will be formed, thus posing no problem. When the vapor pressure of the metal created is low, a mixed oxide in which the oxide of the above metal is mixed in a matrix of an insulator such as silica is preferably used as the metallic oxide film 6.

On the other hand, when the fine particle film or the island-shaped film of discretely distributed fine particles or islands is used as the metallic oxide film 6 as shown in FIG. 3B, the aforementioned leak current can be avoided even if reduction takes place. Generally speaking,-the fine particle film or the island-shaped film of discretely distributed fine particles or islands has a larger electric resistance than that of the continuous film, because there exists spaces between the fine particles or between the islands. Particularly, since the resistance of the film increases exponentially if the coverage of the fine particle film, i.e., a rate of "the area of the fine particles in the film/(the area of the fine particles in the film+the area of the spaces between the fine particles)" becomes as small as about 50% or less, this fine particle film becomes virtually an insulative film even if the fine particles constituting the fine particle film are electrically conductive. In the present invention, the thickness may be considered to be approximately the grain sizes of the fine particles and is thus from several hundred pm to several ten nm, and the coverage of the fine particle film covering the substrate surface can be set to approximately 50% or less accordingly.

As described above, the metallic oxide film 6 can be preferably used in either form, the continuous film, the fine particle film, or the island-shaped film, and can be a mixed film with another oxide or a composite oxide.

It is common practice to form these oxides on the substrate 1 by the physical evaporation technique such as sputtering, but a simpler method that can be applied is a chemical method for applying a solution of an organometallic compound to the substrate by a method of spin coating, aerocoating, dipping, printing, or the like and drying or baking it to form an oxide film.

It is also possible to preliminarily deposit the metal of nickel, cobalt, or iron by the above techniques and thereafter baking it under an ambience containing oxygen to form the oxide.

As described above, since in the present invention, a deposit constituting the electron-emitting portion 5 within the gap 10 is made of graphite-like carbon with good orientation and crystallinity, stable electron emission characteristics can be achieved with excellent conductivity and stability over long time.

Next described is a step type surface conduction electron-emitting device which is a surface conduction electron-emitting device of another structure according to the present invention.

Figure 4:
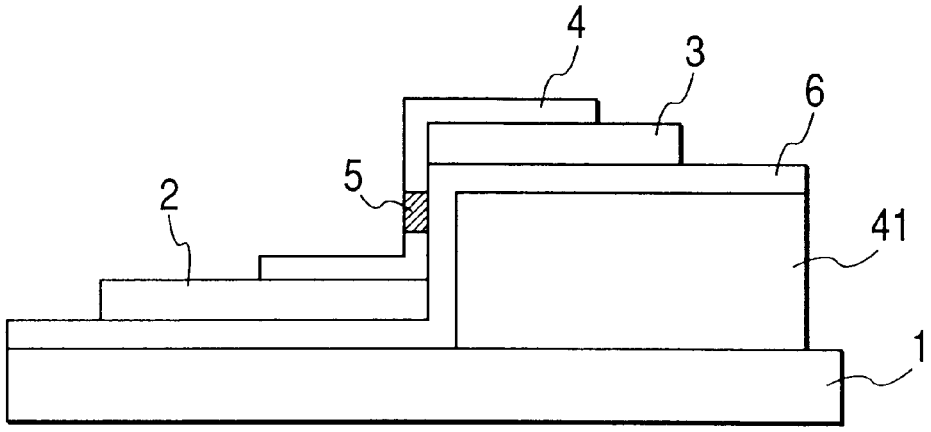
FIG. 4 is a drawing to show another form of a basic surface conduction electron-emitting device according to the present invention.

FIG. 4 is a schematic diagram to show the structure of a basic step type surface conduction electron-emitting device.

In FIG. 4, the same reference symbols denote the same elements as those in FIGS. 1A and 1B. Numeral 41 denotes a step-forming section. The substrate 1, device electrodes 2 and 3, conductive film 4, electron-emitting region 5, and metallic oxide film 6 are those of the same materials as in the plane type surface conduction electron-emitting device described above, and the step-forming section 41 is made of an electrically insulative material such as $SiO_2$ by vacuum deposition, printing, sputtering, or the like. The thickness of the step-forming section 41 corresponds to the device electrode gap L of the plane type surface conduction electron-emitting device described above and is from several ten nm to several ten pm. Although the thickness is determined depending upon the production method of the step-forming section and upon the voltage applied between the device electrodes and the intensity of the electric field capable of emitting electrons, it is preferably in the range of several ten nm to several $\mu$m.

The step-forming section 41 can also be made of the same oxide as the metallic oxide film 6, i.e., the oxide of the single metal element selected from nickel oxide, cobalt oxide, and iron oxide, or the composite oxide including metal elements out of these, or the mixed oxide with the insulator such as silica. In this case, the step-forming section 41 itself can be regarded as the metallic oxide film 6, and it is thus needless to mention that the effect by the present invention can be achieved without especially forming the metallic oxide film 6.

The conductive film 4 is deposited on the device electrodes 2, 3 because it is formed after preparation of the step-forming section 41, metallic oxide film 6, and device electrodes 2 and 3. Although the electron-emitting region 5 is illustrated in a linear form to the step-forming section 41 in FIG. 4, the shape and location thereof are not limited to this, depending upon the fabrication conditions, energization forming conditions, and so on.

There are various conceivable methods as a production method of the electron-emitting device having the electron-emitting region 5 and an example thereof is shown in FIGS. 5A to 5D.

The production method will be described in order referring to FIGS. 1A and 1B, FIGS. 2A to 2D, and FIGS. 5A to 5D.

Figure 5A:
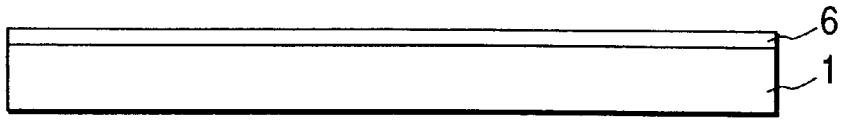
FIG. 5A, FIG. 5B, FIG. 5C, and FIG. 5D are drawings for explaining a basic production method of a surface conduction electron-emitting device according to the present invention.

1) The substrate 1 is cleaned well with a detergent, pure water, and an organic solvent and thereafter the metallic oxide film 6 is formed by sputtering or the like (FIG. 5A). The method for forming the metallic oxide film 6 is not limited to the sputtering method, but it may be made of an organometallic coating material by another method selected from vapor deposition, electron beam deposition, CVD, and so on. The metallic oxide film 6 can also be made by first forming a film layer of the metal and then oxidizing it.

Figure 5B:
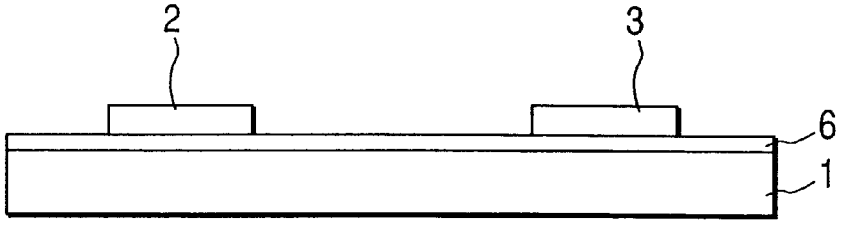

2) Then the material for the device electrodes is deposited on the substrate 1 having the metallic oxide film 6 by vacuum deposition, sputtering, or the like, and thereafter the device electrodes 2, 3 are formed by the photolithography technology (FIG. 5B).

Figure 5C:
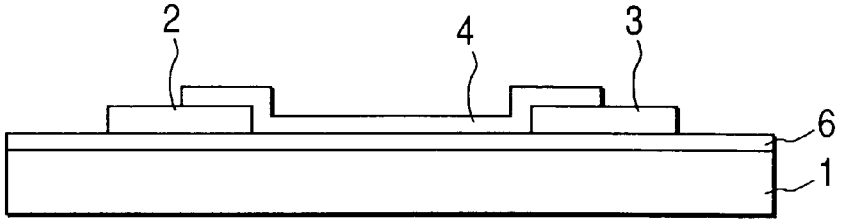

3) Between the device electrode 2 and the device electrode 3 provided on the insulative substrate 1 having the metallic oxide film 6, an organometallic solution is applied and dried to form an organometallic film. The organometallic solution is a solution of an organometallic compound including the principal element of the metal such as Pd, Ni, Au, or Pt. After this, the organometallic film is baked and patterned by lift-off, etching, or the like, thereby forming the conductive film 4 (FIG. 5C). The production method of the conductive film 4 was described by the application method of the organometallic solution herein, but, without having to be limited to this, it may also be formed by vacuum deposition, sputtering, CVD, dispersion application, dipping, a spinner method, an ink jet method, and so on.

Figure 5D:
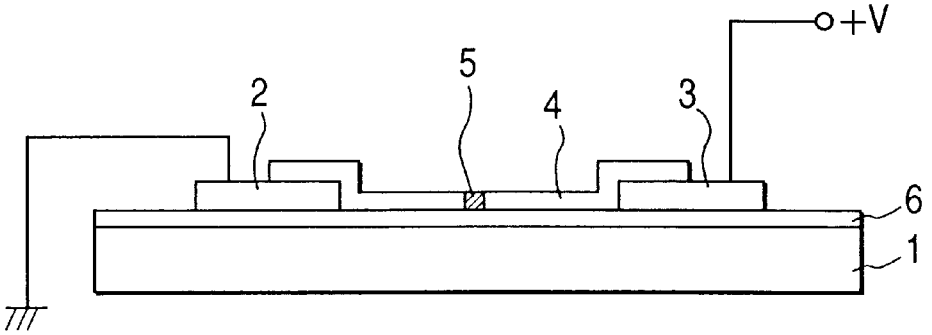

4) Then the energization operation called forming is carried out by applying the pulsed voltage or increasing voltage from an unillustrated power supply between the device electrodes 2, 3, thereby forming the gap of the changed structure in a portion of the conductive film 4 (FIG. 5D). This energization operation locally breaks, deforms, or deteriorates the conductive film 4, and the portion of the changed structure (high-resistance portion) is called the gap 10. The metallic oxide film 6 is exposed in part in this portion.

Figure 6:
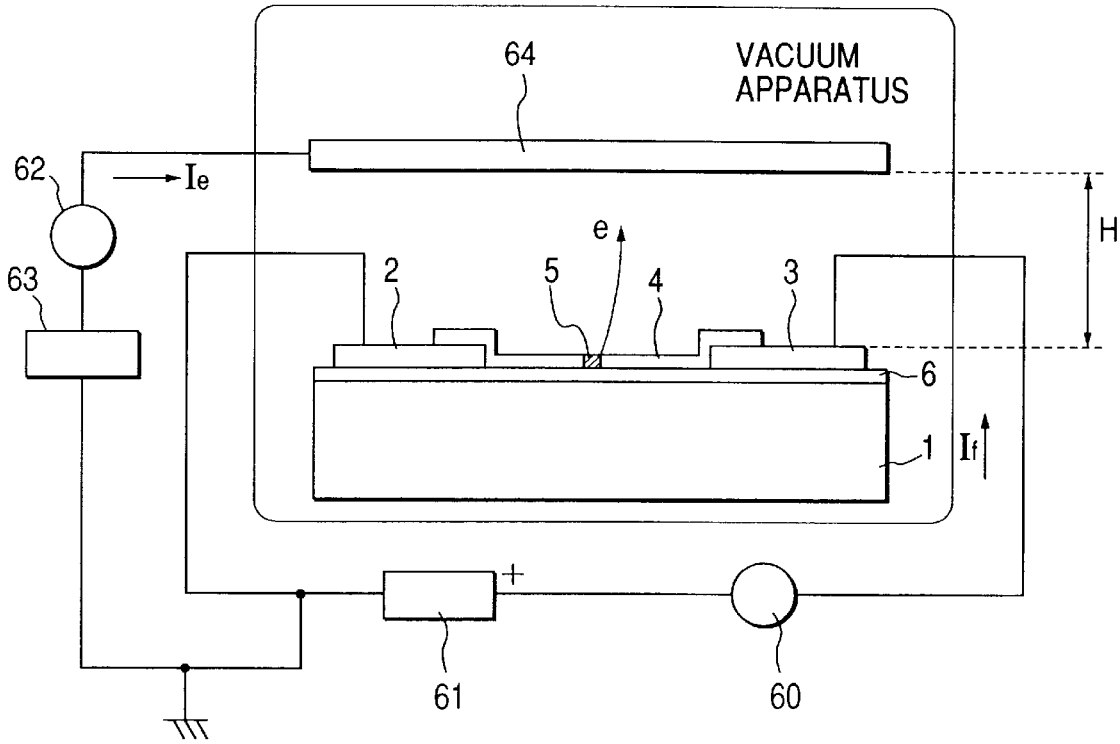
FIG. 6 is a diagram of a measuring and evaluating device used for characteristic evaluation of the surface conduction electron-emitting device according to the present invention.

Electrical operations after the forming operation are carried out in a measuring and evaluating device shown in FIG. 6. The measuring and evaluating device will be described below.

FIG. 6 is a schematic, structural drawing of the measuring and evaluating device for measuring the electron emission characteristics of the device having the structure shown in FIGS. 1A and 1B. In FIG. 6, numeral 1 represents the substrate, 2 and 3 the device electrodes, 4 the conductive film, 5 the electron-emitting region, and 6 the metallic oxide film. Numeral 61 indicates a power supply for applying the device voltage Vf to the device, 60 a current meter for measuring the device current If flowing in the conductive film 4 between the device electrodes 2, 3, 64 an anode electrode for capturing the emission current Ie emitted from the electron-emitting region of the device, 63 a high-voltage supply for applying the voltage to the anode electrode 64, and 62 a current meter for measuring the emission current Ie emitted from the electron-emitting region 5 of the device.

For measuring the above device current If and emission current Ie of the electron-emitting device, the power supply 61 and current meter 60 are connected to the device electrodes 2, 3 and the anode electrode 64 to which the power supply 63 and current meter 62 are connected is located above the electron-emitting device. The electron-emitting device and anode electrode 64 are set in a vacuum apparatus and the vacuum apparatus is equipped with devices necessary for the vacuum apparatus, including an evacuation pump, a vacuum meter, etc., though not illustrated, so as to measure and evaluate the device under a desired vacuum. The evacuation pump is comprised of a normal high-vacuum system such as a turbo-pump or a rotary pump, or a high-vacuum system not using oil, such as a magnetic levitation turbo-pump or a dry pump, and an ultra-high vacuum system consisting of an ion pump. The whole vacuum apparatus and the electron-emitting device can be heated by a heater not illustrated.

The voltage of the anode electrode is measured in the range of 1 kV to 10 kV and the distance H between the anode electrode and the electron-emitting device in the range of 2 mm to 8 mm.

The forming operation is carried out by a method for applying pulses whose pulse peak values are a constant voltage or by a method for applying voltage pulses with increasing pulse peak values. First, FIG. 7A illustrates the voltage waveform where pulses with pulse peak values of the constant voltage are applied.

Figure 7A:
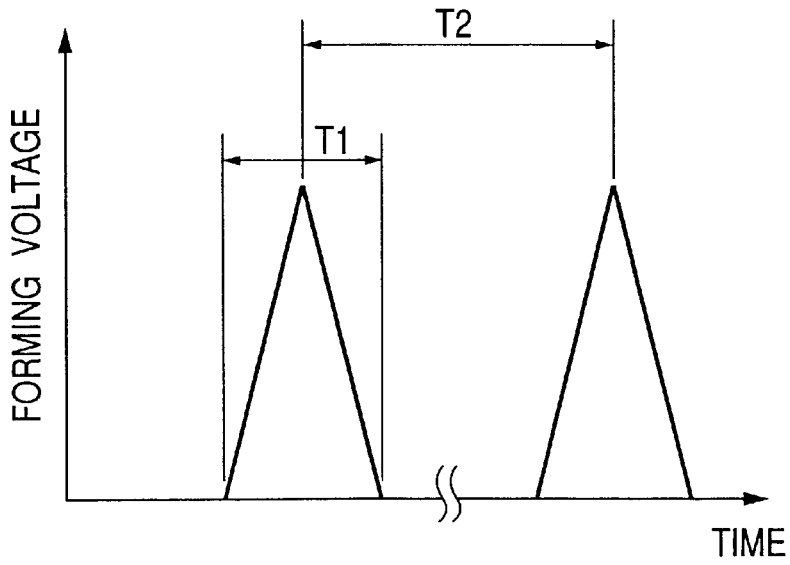
FIG. 7A and FIG. 7B are diagrams to show examples of voltage waveform in the forming operation according to the present invention.

In FIG. 7A, T1 and T2 indicate the pulse width and pulse separation of the voltage waveform, T1 being 1 $\mu$sec–10 msec and T2 being 10 $\mu$sec–100 msec, and the peak value of the triangular waves (the peak voltage upon forming) is properly selected as occasion may demand.

Figure 7B:
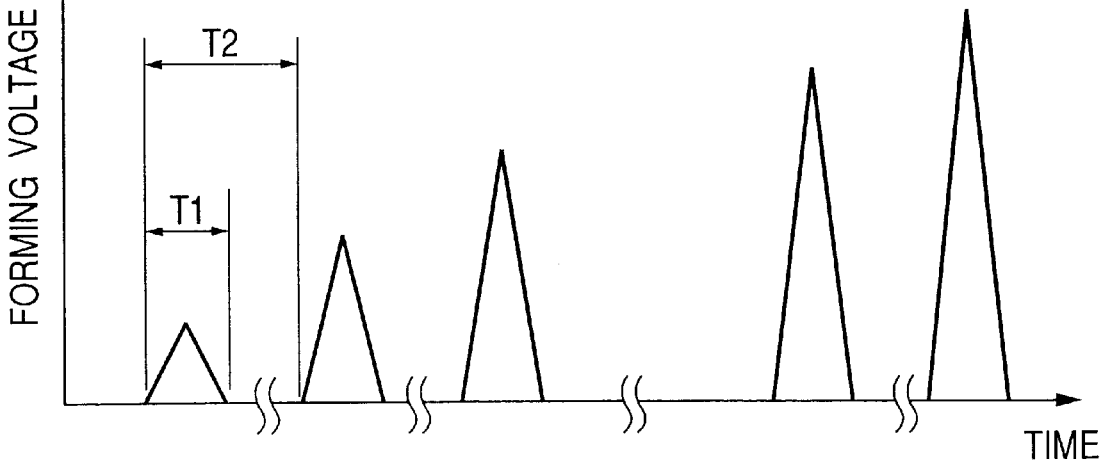

Next, FIG. 7B shows the voltage waveform where the voltage pulses are applied with increasing pulse peak values.

In FIG. 7B, T1 and T2 indicate the pulse width and pulse separation of the voltage waveform, T1 being 1 $\mu$sec–10 msec and T2 being 10 $\mu$sec–100 msec, and the peak values of the triangular waves (the peak voltages upon forming) are increased, for example, in steps of about 0.1 V.

The end of the forming operation is determined as follows. A voltage so low as not to locally break or deform the conductive film 2, for example the pulse voltage of about 0.1 V, is placed between the forming pulses to measure the device current and the resistance is calculated. For example, when the resistance is not less than 1 MΩ, the forming is ended.

On the occasion of forming the gap as described above, the forming operation is carried out by applying the triangular pulses between the electrodes of the device, but the waves applied between the electrodes of the device do not have to be limited to the triangular waves, but may be any other waves such as rectangular waves. In addition, the peak value, the pulse width, the pulse separation, etc. of the waves are not limited to the above-stated values, either, but appropriate values can be selected according to the resistance etc. of the electron-emitting device so as to form the electron-emitting region well.

5) Next, the device after the forming undergoes the activation operation. The step of activation operation is carried out under an ambience containing an organic substance, and this ambience can be established, for example, by utilizing an organic substance remaining in the ambience after evacuation of the inside of a vacuum vessel by an oil diffusion pump or a rotary pump, or by sufficiently evacuating the inside once into a vacuum by an ion pump and introducing an adequate organic substance into the vacuum. The preferred pressure of the organic substance at this time differs depending upon the aforementioned application form, the shape of the vacuum vessel, the kind of the organic substance, and so on, and is thus properly set depending upon the case.

The appropriate organic substance can be selected from aliphatic hydrocarbons represented by alkane, alkene, and alkyne, aromatic hydrocarbons, alcohols, aldehydes, ketones, amines, nitrites, organic acids such as phenol, carboxylic acid, and sulfonic acid, and so on. Specific examples of the organic substance include saturated hydrocarbons represented by $C_nH_{2n+2}$, such as methane, ethane, and propane, unsaturated hydrocarbons represented by the composition formula of $C_nH_{2n}$ or the like, such as ethylene and propylene, benzene, toluene, methanol, ethanol, formaldehyde, acetaldehyde, acetone, methyl ethyl ketone, methyl amine, ethyl amine, phenol, benzonitrile, acetonitrile, formic acid, acetic acid, propionic acid, and so on.

By this operation, carbon is deposited from the organic substance present in the ambience onto the device, so as to bring about extreme change in the device current If and in the emission current Ie.

In the present invention, the metallic oxide film 6 is partly exposed in the portion where the conductive film 4 is locally broken or deformed by the forming operation (i.e., in the gap 10), so that carbon depositing from the organic substance experiences the catalytic action by the metal element included in the metallic oxide film 6, i.e., iron, cobalt, or nickel in the deposition process.

Accordingly, the deposition rate of carbon is larger than on the other oxide surface not subject to the catalytic action (for example, on silica), i.e., the time necessary for the activation becomes shorter, and the carbon deposit is graphite-like carbon with excellent orientation and crystallinity.

The orientation of the carbon deposit is one of the layer structure nearly parallel to the surface configuration of the metallic oxide film 6. When the surface configuration of the metallic oxide film 6 is parallel to the substrate surface (see FIG. 3A), the orientation of carbon in the gap 10 becomes almost parallel to the substrate surface, which is more preferable.

Determination of the end of the activation step is properly carried out with measuring the device current If and/or the emission current Ie. The pulse width, the pulse separation, the pulse peak value, etc. can be properly set as occasion may demand.

The graphite-like carbon in the present invention involves carbon of the perfect graphite crystal structure (so called HOPG), carbon of slightly disordered crystal structure having the crystal grains of about 20 nm (PG), and carbon of more disordered crystal structure having the crystal grains of about 2 nm (GC), but the preferred structure is one containing carbon having the graphite layer separation of not more than 0.35 nm (perfect graphite has the separation of 0.335 nm). This means that carbon even with disordered layers of grain boundaries between graphite grains or the like can be used favorably.

The deposition mechanism of carbon in the surface conduction electron-emitting device according to the present invention is not always said to be clear, but the graphite-like carbon with good crystallinity is formed in the orientation of the layer structure parallel to the metallic oxide film 6 as a consequence of the catalytic action by the above metal element in the deposition process. Since the carbon with good orientation and crystallinity is a material excellent in electrical conductivity and thermal stability, the electron-emitting device of the present invention is considered to be capable of demonstrating stable electron-emission characteristics over long time.

The thickness of the above graphite-like carbon is preferably in the range of not more than 50 nm, more preferably in the range of not more than 30 nm.

6) The electron-emitting device thus produced is then subjected preferably to the stabilization step. This step is a step of exhausting the organic substance from the vacuum vessel. The pressure of the vacuum vessel is preferably not more than 1 to $3\times10^{-7}$ Torr and particularly preferably not more than $1\times10^{-8}$ Torr. The evacuation unit for evacuating the vacuum vessel is preferably one not using oil in order to prevent the oil generated from the unit from affecting the characteristics of the device. Specifically, the evacuation unit can be selected, for example, from a sorption pump, an ion pump, and so on. During evacuation of the inside of the vacuum vessel, the whole vacuum vessel is preferably heated to facilitate exhaust of the organic molecules adsorbing to the inner wall of the vacuum vessel and to the electron-emitting device. The heating at this time is carried out at 80–350° C., preferably at 200° C. or more, and for as longer time as possible, but, without having to be limited to these conditions, the conditions are properly selected depending upon various conditions including the size and shape of the vacuum vessel, the structure of the electron-emitting device, and so on.

The ambience during driving after completion of the stabilization step is preferably that upon the end of the above stabilization step, but, without having to be limited to this, sufficiently stable characteristics can be maintained even with some increase of the pressure per se as long as the organic substance is adequately removed.

The employment of the vacuum ambience as described can suppress new deposition of carbon or the carbon compound, so that the device current If and emission current Ie are stabilized.

The fundamental characteristics of the electron-emitting device, to which the present invention can be applied and which is fabricated according to the above-stated production method, will be described referring to FIG. 6 and FIG. 8.

Figure 8:
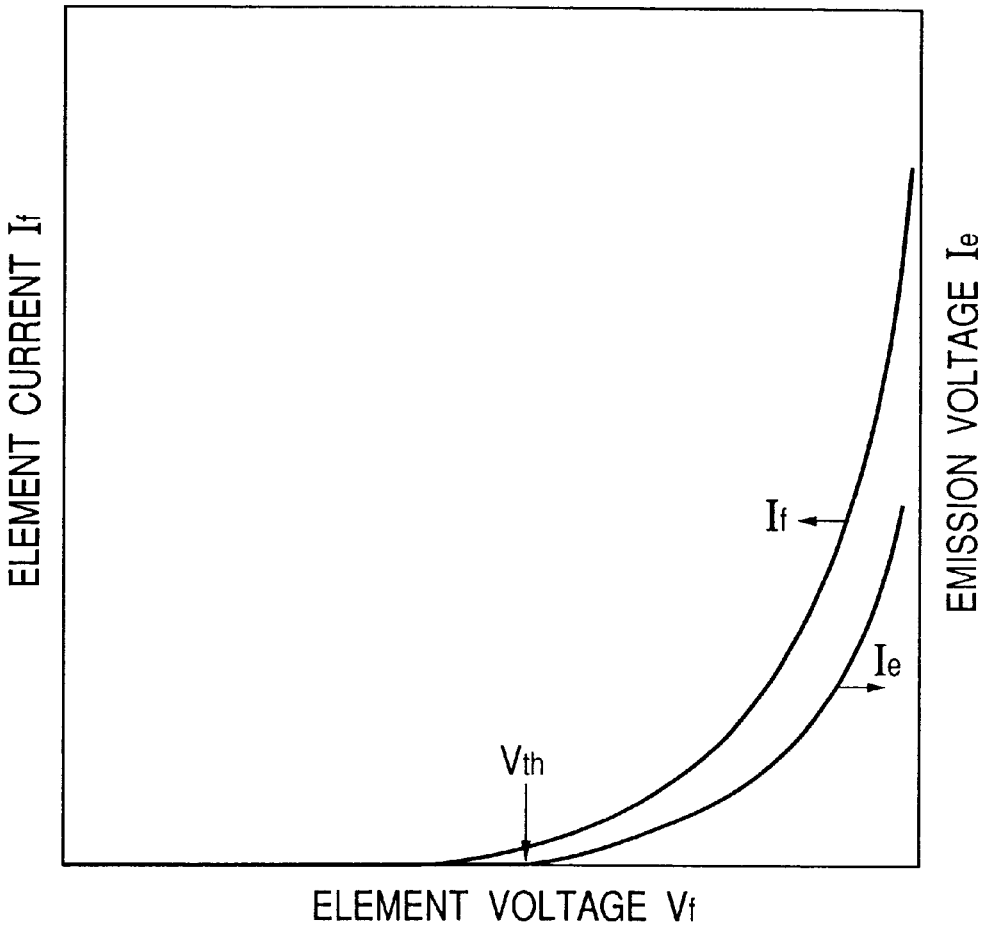
FIG. 8 is a diagram to show a typical example of the relation among the emission current, the device current, and the device voltage of the surface conduction electron-emitting device according to the present invention.

FIG. 8 shows a typical example of the relation of the emission current Ie and device current If to the device voltage Vf measured by the measuring and evaluating device shown in FIG. 6. FIG. 8 is illustrated in arbitrary units, because the emission current Ie is extremely smaller than the device current If. Linear scales are employed for the both currents. As apparent from FIG. 8, the present electron-emitting device has three properties as to the emission current Ie.

The first property is that the present device shows a sudden increase of the emission current Ie with application of the device voltage over a certain voltage (which will be called a threshold voltage, Vth in FIG. 8) and little emission current Ie is detected with application of the device voltage smaller than the threshold voltage Vth. Namely, the device is a nonlinear device having the definite threshold voltage Vth to the emission current Ie.

Second, the emission current Ie is dependent on the device voltage Vf, so that the emission current Ie can be controlled by the device voltage Vf.

Third, the emission charge captured by the anode electrode 64 is dependent on the period of application of the device voltage Vf. Namely, an amount of the charge captured by the anode electrode 64 can be controlled by the period of application of the device voltage Vf.

In FIG. 8 the solid line indicates an example in which the device current If monotonically increases against the device voltage Vf (called MI characteristics). There is also the case wherein the device current If demonstrates the voltage-controlled negative resistance characteristics (called VCNR characteristics) against the device voltage Vf (though not illustrated). These characteristics can be controlled by controlling the aforementioned steps.

The electron emission characteristics can be controlled readily according to the input signal by using the characteristics of the surface conduction electron-emitting device as described above. Further, since the electron-emitting device according to the present invention has the stable and high-luminance electron emission characteristics over long time, it is expected to be applied in many fields.

Examples of application of the electron-emitting device to which the present invention can be applied will be described below.

For example, an electron source or an image-forming apparatus can be constructed by arraying a plurality of surface conduction electron-emitting devices according to the present invention on the substrate.

The array of devices on the substrate can be arranged, for example, according to either one of the following array configurations. An array configuration (called a ladder type) is such that a lot of electron-emitting devices are arranged in parallel, many rows are arrayed of the electron-emitting devices in a certain direction (called a row direction), the both ends of the individual devices being connected to wires in each row, and electrons are controlled by a control electrode (called a grid) disposed in a space above the electron source in the direction perpendicular to the wires (called a column direction). Another array configuration is such that n Y-directional wires are placed through an inter-layer insulation layer above m X-directional wires described hereinafter and an X-directional wire and a Y-directional wire are connected to a pair of device electrodes of each surface conduction electron-emitting device. This will be referred to hereinafter as a simple matrix configuration.

This simple matrix configuration will be described first in detail.

According to the aforementioned features of the three fundamental properties of the surface conduction electron-emitting device according to the present invention, the electrons emitted from the surface conduction electron-emitting device can be controlled by the peak value and the width of the pulsed voltage applied between the opposed device electrodes in the range over the threshold voltage. On the other hand, electrons are little emitted with the voltage smaller than the threshold voltage. This property permits the surface conduction electron-emitting devices to be selected according to the input signal, so as to control the amounts of electrons emitted therefrom, by properly applying the above pulsed voltage to the individual devices even in the configuration of the many electron-emitting devices arrayed.

The structure of an electron source substrate constructed based on this principle will be described below referring to FIG. 9.

The m X-directional wires 92 are comprised of DX1, DX2, . . . , DXm, which are made of an electroconductive metal or the like in a desired pattern on the substrate 1 by vacuum deposition, printing, sputtering, or the like. The material, thickness, and width of the wires, etc. are so designed as to supply almost uniform voltage to the many surface conduction electron-emitting devices. An interlayer insulation layer not illustrated is placed between these m X-directional wires 92 and n Y-directional wires 93 to establish electrical insulation between them, thus composing the matrix wiring (where m and n both are positive integers).

The interlayer insulation layer not illustrated is $SiO_2$ or the like formed by vacuum deposition, 1printing, sputtering, or the like, which is made in a desired pattern over the entire surface or in part of the substrate 91 on which the X-directional wires 92 are formed. Particularly, the thickness, material, and production method thereof are properly set so as to endure the potential difference at an intersection between the X-directional wire 92 and the Y-directional wire 93. The X-directional wires 92 and Y-directional wires 93 are routed out each as an external terminal.

The film of the oxide of the single metal element selected from nickel oxide, cobalt oxide, and iron oxide, or the film of the composite oxide including a plurality of metal elements out of these metals is formed on the insulative substrate 1 to the above interlayer insulation layer (not illustrated) immediately below the surface conduction electron-emitting devices 94.

Further, the opposed electrodes (not illustrated) of the surface conduction electron-emitting devices 94 are electrically connected by connecting each line 95 of a conductive metal or the like to one of the m X-directional wires 92 (DX1, DX2, . . . , DXm) and to one of the n Y-directional wires 93 (DY1, DY2, . . . , DYn) in the same manner as described previously.

Here, some or all of the component elements may be common to or different among the conductive metals of the m X-directional wires 92, n Y-directional wires 93, connecting lines 95, and opposed device electrodes. These materials are properly selected, for example, from the materials from the aforementioned materials for the device electrodes.

Although the details will be described hereinafter, an unillustrated scanning signal applying means for applying a scanning signal for scanning of the rows of the surface conduction electron-emitting devices 94 arrayed in the X-direction according to the input signal is electrically connected to the X-directional wires 92, while an unillustrated modulation signal generating means for applying a modulation signal for modulating each column of the surface conduction electron-emitting devices 94 arrayed in the Y-direction according to the input signal is electrically connected to the Y-directional wires.

The driving voltage applied to each of the surface conduction electron-emitting devices is supplied as a difference voltage between the scanning signal and the modulation signal applied to the device.

Figure 10:
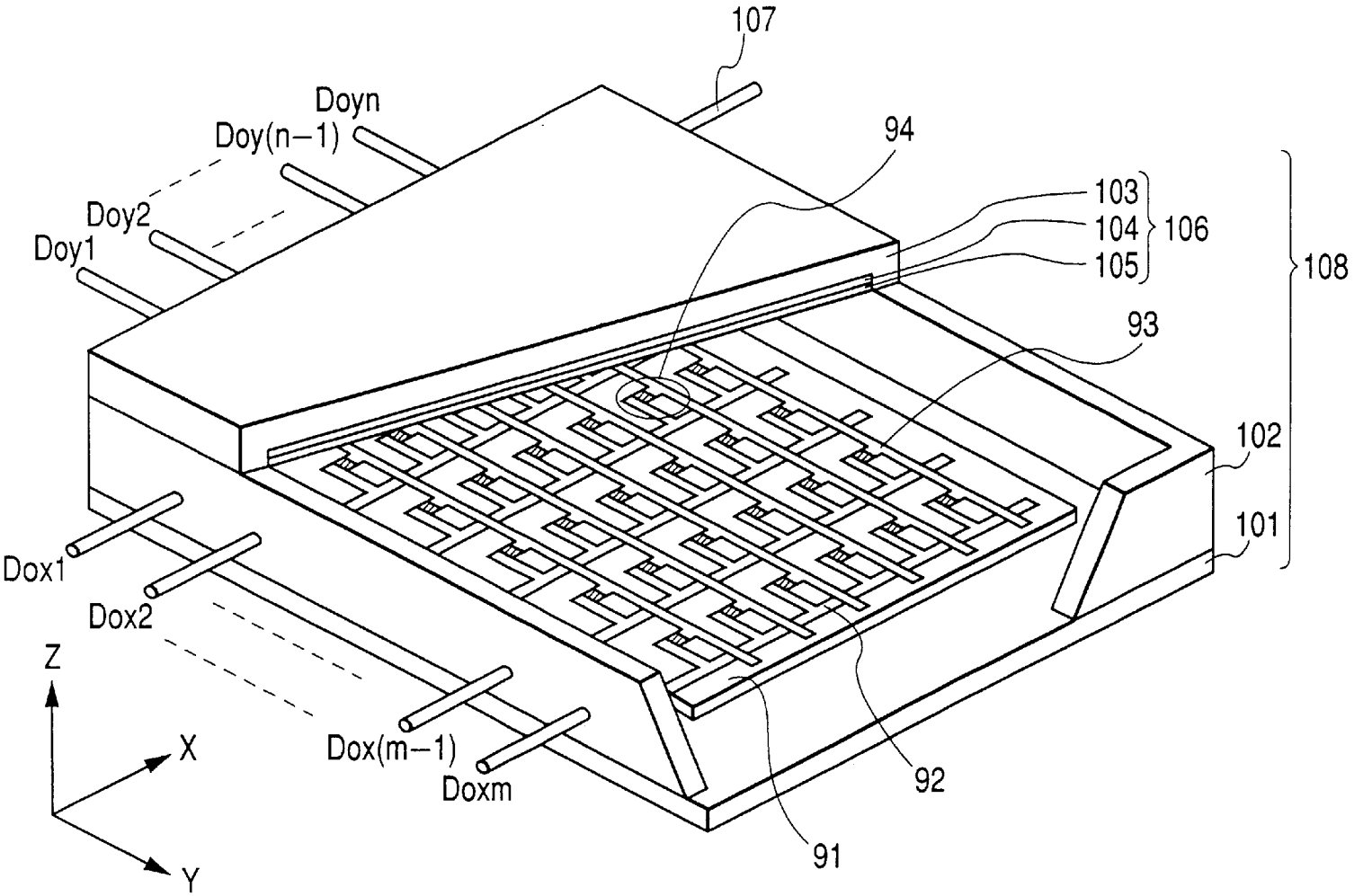
FIG. 10 is a drawing to show the fundamental structure of an image-forming apparatus according to the present invention.
Figure 11A:
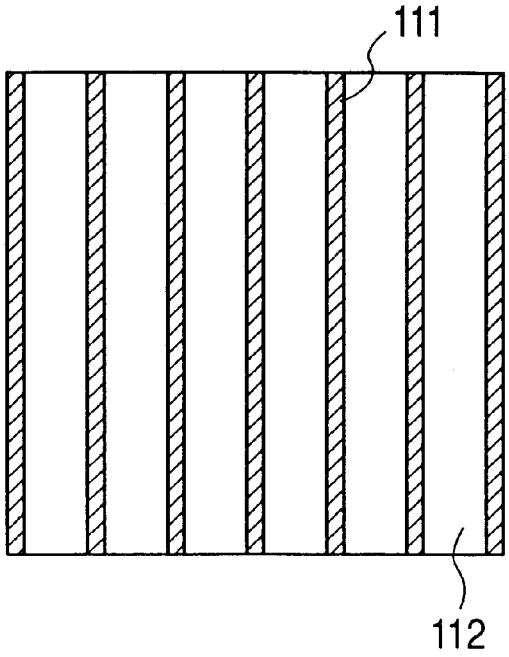
FIG. 11A and FIG. 11B are drawings to show fluorescent films used in the image-forming apparatus of FIG. 10.
Figure 11B:
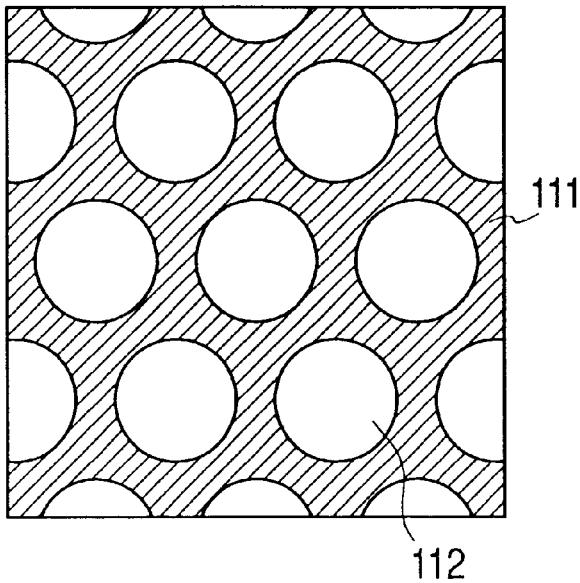

Next described referring to FIG. 10 and FIGS. 11A and 11B are an electron source using the electron source substrate prepared as described above, and an image-forming apparatus used for display or the like. FIG. 10 is a diagram to show the fundamental structure of the image-forming apparatus and FIGS. 11A and 11B illustrate fluorescent films.

In FIG. 10, numeral 91 represents the electron source substrate in which a plurality of electron-emitting devices are arrayed, 101 a rear plate to which the electron source substrate 91 is fixed, and 106 a face plate in which a fluorescent film 104, a metal back 105, etc. are formed on an internal surface of glass substrate 103. Numeral 102 indicates a support frame, and the rear plate 101, support frame 102, and face plate 106 are coated with a frit glass and baked at 400–500° C. in the atmosphere or in nitrogen for ten or more minutes, so as to seal them, thereby composing an envelope 108.

In FIG. 10, numeral 94 corresponds to the surface conduction electron-emitting region shown in FIGS. 1A and 1B or in FIGS. 2A to 2D. Numerals 92 and 93 denote the X-directional wires and Y-directional wires connected to the pairs of device electrodes of the surface conduction electron-emitting devices. If the wires to these device electrodes are made of the same wiring material as the device electrodes, they are also called the device electrodes in some cases.

The envelope 108 is comprised of the face plate 106, the support frame 102, and the rear plate 101 as described above, but, because the rear plate 101 is provided mainly for the purpose of reinforcing the strength of the substrate 91, the separate rear plate 101 can be omitted if the substrate 91 itself has sufficient strength. In that case, the support frame 102 is bonded directly to the substrate 91, and the envelope 108 is thus constructed of the face plate 106, the support frame 102, and the substrate 91.

As another example, the envelope 108 can also be constructed with sufficient strength against the atmospheric pressure by mounting an unrepresented support called a spacer between the face plate 106 and the rear plate 101.

FIGS. 11A and 11B illustrate fluorescent films. The fluorescent film 104 is constructed of only a fluorescent member in the monochrome case. In the case of a color fluorescent film, the fluorescent film is constructed of fluorescent members 112 and a black conductive material 111 called black stripes or a black matrix depending upon the array of the fluorescent members. Purposes of provision of the black stripes or the black matrix are to make color mixture or the like unobstructive by blacking portions between the fluorescent members 112 of the three primary colors necessitated in the case of the color display, and to suppress decrease in contrast due to reflection of ambient light on the fluorescent film 104. A material for the black stripes can be selected from materials including the principal component of graphite commonly widely used, and also from any electrically conductive materials with little transmission and little reflection of light.

A method for applying the fluorescent members to the glass substrate 103 is selected from a precipitation method, printing, and the like, in either the monochrome or the color case.

The metal back 105 is normally provided on the inner surface of the fluorescent film 104. Purposes of the metal back are to enhance the luminance by specular reflection of light traveling to the inside out of the light emitted from the fluorescent members, toward the face plate 106, to use the metal back as an electrode for applying the electron beam acceleration voltage, to protect the fluorescent members from damage due to collision of negative ions generated in the envelope, and so on. The metal back can be fabricated after production of the fluorescent film by carrying out a smoothing operation (normally called filming) of the inside surface of the fluorescent film and thereafter depositing Al by vacuum deposition or the like.

The face plate 106 may be provided with a transparent electrode (not illustrated) on the outer surface side of the fluorescent film 104 in order to enhance the electrically conductive property of the fluorescent film 104.

On the occasion of carrying out the aforementioned sealing, sufficient position alignment is achieved in the color case in order to match the electron-emitting devices with the respective color fluorescent members.

The envelope 108 is encapsulated after evacuated to the vacuum degree of about $1\times10^{-7}$ Torr through an unrepresented exhaust pipe. In certain cases a getter operation is also carried out in order to maintain the vacuum degree after the encapsulation of the envelope 108. This getter operation is an operation for heating a getter placed at a predetermined position (not illustrated) in the envelope 108 by a heating method such as resistance heating or high-frequency heating to form a deposit film, immediately before or after execution of the encapsulation of the envelope 108. The getter normally contains a principal component of Ba or the like, and maintains, for example, the vacuum degree of $1\times10^{-5}$ to $1\times10^{-7}$ Torr by adsorption action of the deposit film.

In the image displaying apparatus of the present invention completed as described above, the voltage is applied to each electron-emitting device through the terminals outside the container, Dox1 to Doxm and Doy1 to Doyn, to make the device emit electrons, a high voltage of not less than several kV is applied to the metal back 105 or to the transparent electrode (not illustrated) through a high-voltage terminal 107 to accelerate electron beams, and the electron beams are guided onto the fluorescent film 104 to bring about excitation and luminescence thereof, thereby displaying an image.

Figure 19:
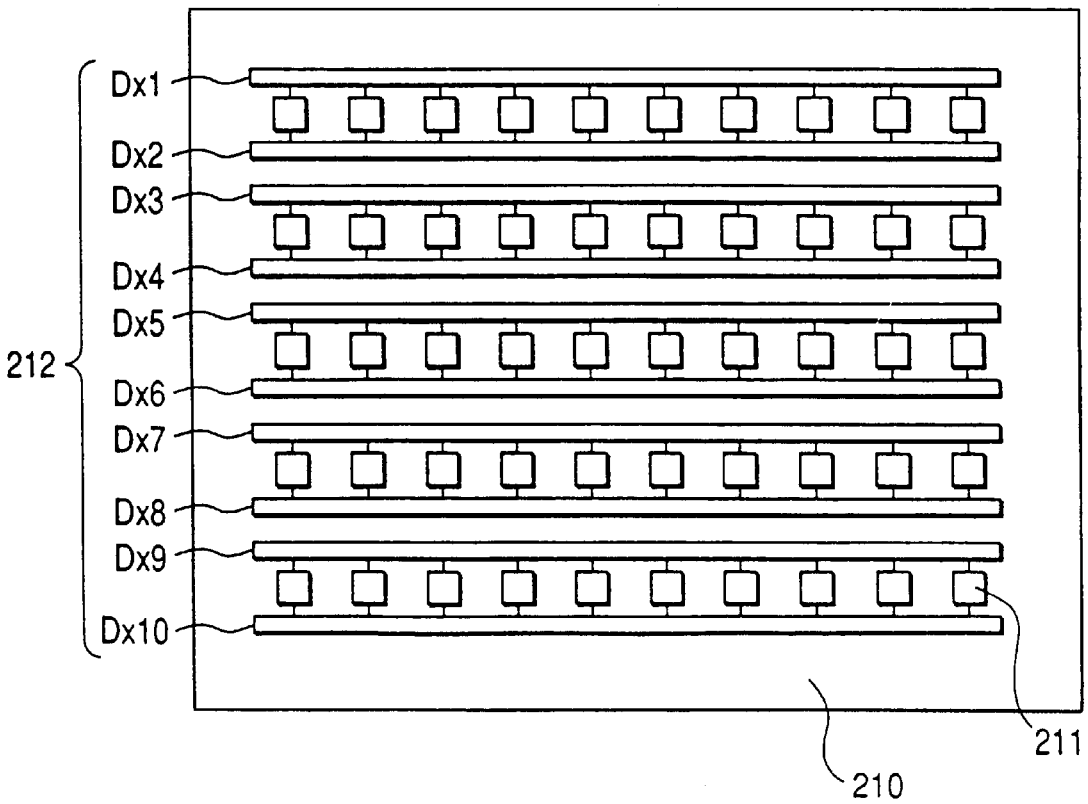
FIG. 19 is a schematic view to show an example of an electron source of a ladder type configuration.
Figure 20:
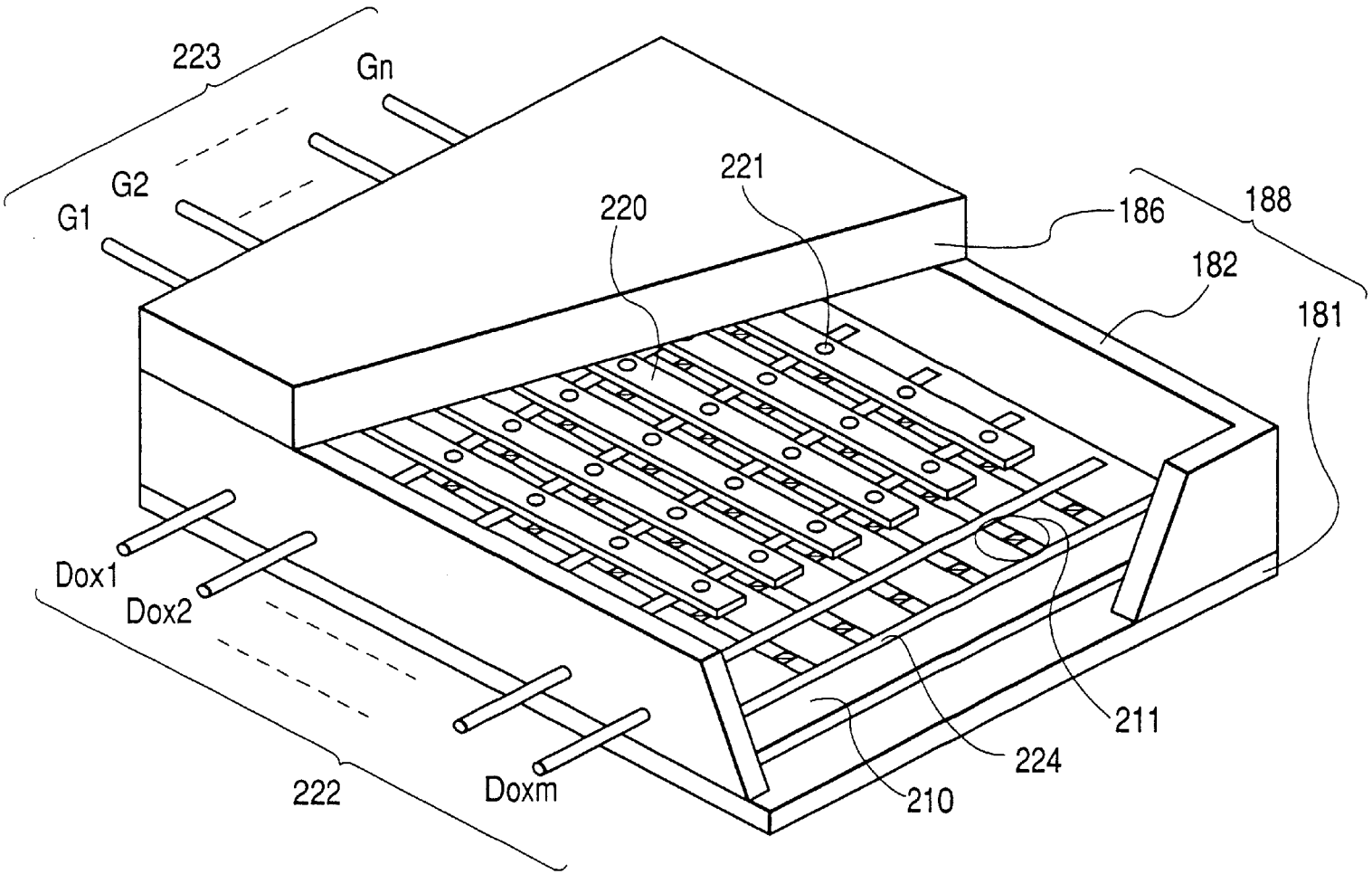
FIG. 20 is a schematic diagram to show an example of a panel structure in an image-forming apparatus provided with the electron source of the ladder type configuration.

Next described referring to FIG. 19 and FIG. 20 is the ladder type configuration in which many electron-emitting devices arranged in parallel are connected each at the both ends, many rows of electron-emitting devices are arranged in a direction (called a row direction), and electrons from the electron-emitting devices are controlled by a control electrode (also called a grid) provided above the electron-emitting devices in the direction perpendicular to the wires (called a column direction).

The electron source and image-forming apparatus of the ladder type configuration will be described referring to FIG. 19 and FIG. 20.

FIG. 19 is a schematic diagram to show an example of the electron source of the ladder type configuration. In FIG. 19, numeral 210 represents the electron source substrate and 211 the electron-emitting devices. Numeral 212, Dx1 to Dxm, denotes common wires for connecting the electron-emitting devices 211. A plurality of electron-emitting devices 211 are arranged in parallel in the X-direction (which will be called device rows) on the substrate 210. A plurality of device rows are provided to compose an electron source. Each device row can be driven independently by applying a driving voltage between the common wires of each device row. Specifically, a voltage exceeding the electron emission threshold is applied to a device row expected to emit the electron beams, whereas a voltage below the electron emission threshold is applied to a device row not expected to emit the electron beams. The common wires Dx2 to Dx9 between the device rows can be shared; for example, Dx2 and Dx3 can be constructed of a single wire.

FIG. 20 is a schematic diagram to show an example of the panel structure in the image-forming apparatus provided with the electron source of the ladder type configuration. Numeral 220 is the grid electrode, 221 holes through which electrons pass, and 222 terminals outside the container, comprised of Dox1, Dox2, . . . , Doxm. Numeral 223 represents terminals outside the container, comprised of G1, G2, . . . , Gn connected to the grid electrode 220, and 224 the electron source substrate where the common wires between the device rows are shared. A significant difference between the image-forming apparatus shown herein and the image-forming apparatus of the simple matrix configuration shown in FIG. 10 is whether or not the grid electrode 220 is provided between the electron source substrate 210 and the face plate 186.

In FIG. 20, there is the grid electrode 220 provided between the substrate 210 and the face plate 186. The grid electrode 220 is provided for modulating the electron beams emitted from the surface conduction electron-emitting devices and is provided with circular apertures 221, one each per device, for allowing the electron beams to pass toward the electrodes of the stripe pattern provided perpendicular to the device rows of the ladder type configuration. The shape and placement position of the grid are not limited to those shown in FIG. 20. For example, the apertures may be passing pores of a mesh pattern, and the grid can also be located around or near the surface conduction electron-emitting devices.

The terminals 222 and grid terminals 223 outside the container are electrically connected to a control circuit not illustrated.

In the image-forming apparatus of the present example, a modulation signal for one line of image is simultaneously applied to each grid electrode column in synchronism with successive driving (scanning) of the device rows row by row. This permits control of radiation of each electron beam to the fluorescent member, whereby an image can be displayed line by line.

It should be noted that the structure described above is the schematic structure required to fabricate the suitable image-forming apparatus used for display or the like and that the detailed portions, for example such as the material for each member, can be properly selected so as to suit application of the image apparatus without having to be limited to the contents described above.

Figure 12:
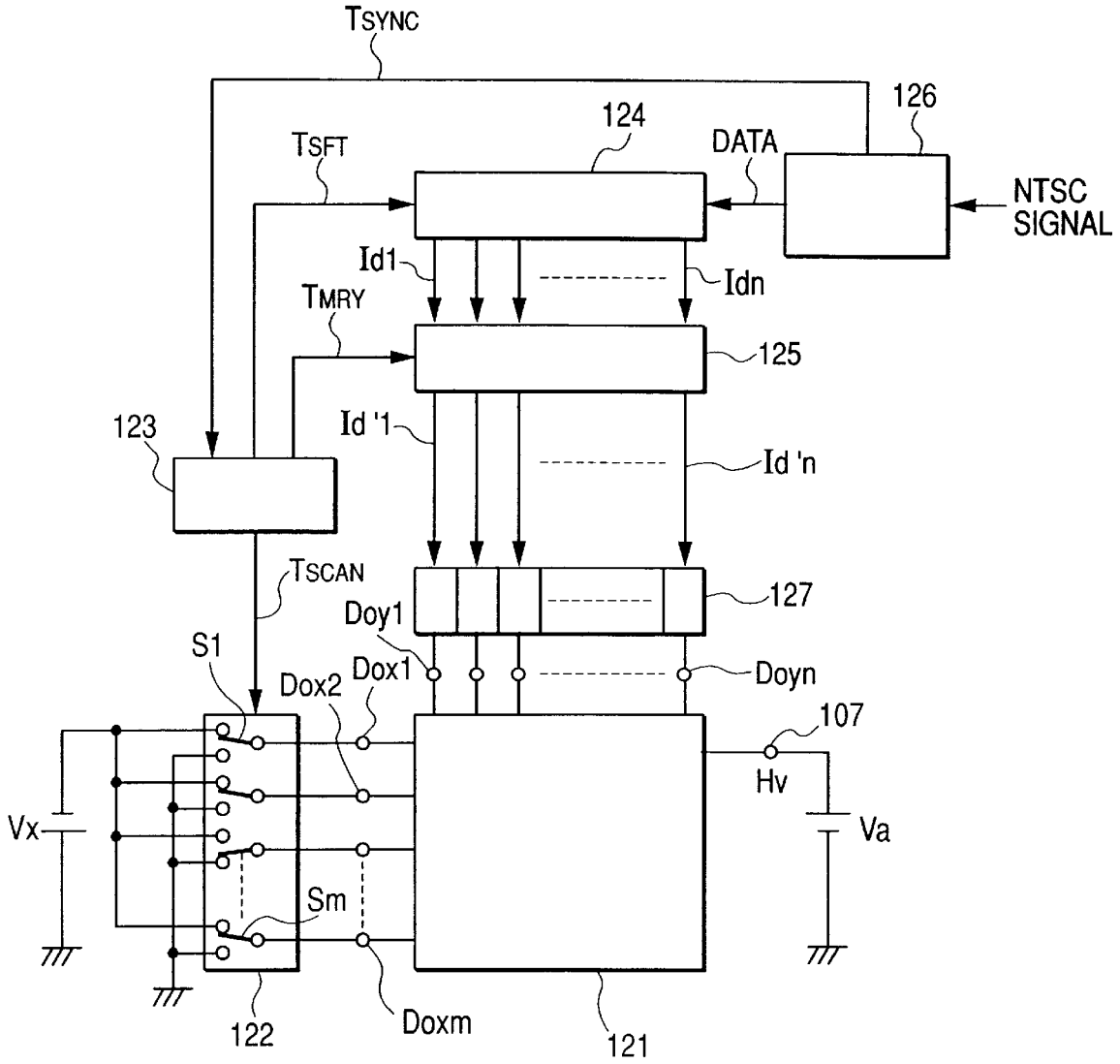
FIG. 12 is a block diagram of a driving circuit in an example in which the image-forming apparatus according to the present invention performs the display according to TV signals of the NTSC method.

Next described referring to FIG. 12 is a structural example of the driving circuit for performing the television display based on TV signals of the NTSC method, on the display panel constructed using the electron source of the simple matrix configuration.

FIG. 12 is a block diagram to show an example of the driving circuit for effecting the display according to the TV signals of the NTSC method. In FIG. 12, numeral 121 designates the display panel, 122 a scanning signal generating circuit, 123 a timing control circuit, and 124 a shift register. Numeral 125 denotes a line memory, 126 a synchronous signal separator, 127 a modulation signal generator, and Vx and Va dc voltage supplies.

The display panel 121 is connected to the external, electric circuits through the terminals Dox1 to Doxm, the terminals Doy1 to Doyn, and the high-voltage terminal Hv. Applied to the terminals Dox1 to Doxm are scanning signals for successively driving the electron source provided in the display panel, i.e., a group of surface conduction electron-emitting devices matrix-wired in a matrix of m rows×n columns row by row (every n devices).

Applied to the terminals Doy1 to Doyn are modulation signals for controlling an output electron beam from each of surface conduction electron-emitting devices in a row selected by the scanning signal. The dc voltage, for example, of 10 kV is supplied from the dc voltage supply Va to the high-voltage terminal Hv, and this is the acceleration voltage for imparting sufficient energy for excitation of the fluorescent members to the electron beams emitted from the surface conduction electron-emitting devices.

The scanning signal generating circuit 122 is provided with m switching devices inside (which are schematically indicated by S1 to Sm in the drawing). Each switching device selects either the output voltage of the dc voltage supply Vx or 0 V (the ground level) to be electrically connected to the terminal Dox1 to Doxm of the display panel 121. Each switching device of S1 to Sm operates based on the control signal Tscan outputted from the control circuit 123, and can be constructed of a combination of such switching devices as FETs, for example.

The dc voltage supply Vx in the present example is so set as to output such a constant voltage that the driving voltage applied to the devices not scanned based on the characteristics (the electron emission threshold voltage) of the surface conduction electron-emitting devices is not more than the electron emission threshold voltage.

The timing control circuit 123 has a function to match operations of the respective sections so as to achieve the appropriate display based on the image signals supplied from the outside. The timing control circuit 123 generates each control signal of Tscan, Tsft, and Tmry to each section, based on the synchronous signal Tsync sent from the synchronous signal separator 126.

The synchronous signal separator 126 is a circuit for separating a synchronous signal component and a luminance signal component from the TV signal of the NTSC method supplied from the outside, which can be constructed using an ordinary frequency separator (filter) circuit or the like. The synchronous signal separated by the synchronous signal separator 126 is composed of a vertical synchronous signal and a horizontal synchronous signal, but it is illustrated as a Tsync signal herein for convenience' sake of description. The luminance signal component of image separated from the aforementioned TV signal is indicated by DATA signal for convenience' sake. The DATA signal is input into the shift register 124.

The shift register 124 is a register for performing serial/parallel conversion for each line of image of the aforementioned DATA signal serially input in time series, which operates based on the control signal Tsft sent from the timing control circuit 123 (this means that the control signal Tsft can be said to be a shift clock of the shift register 124). The data of each image line after the serial/parallel conversion (corresponding to the driving data for the N electron-emitting devices) is outputted as N parallel signals of Id1 to Idn from the shift register 124.

The line memory 125 is a storage device for storing the data of one image line during a necessary period, which properly stores the data, of Id1 to Idn according to the control signal Tmry sent from the timing control circuit 123. The stored data is outputted as I'd1 to I'dn to the modulation signal generator 127.

The modulation signal generator 127 is a signal source for properly modulating driving of each of the surface conduction electron-emitting devices according to each of the image data I'd1 to I'dn, and output signals therefrom are applied through the terminals Doy1 to Doyn to the surface conduction electron-emitting devices in the display panel 121.

As described previously, the electron-emitting devices, to which the present invention can be applied, have the following fundamental characteristics concerning the emission current Ie. Specifically, there is the definite threshold voltage Vth for electron emission, so that electron emission occurs only upon application of the voltage over Vth. With voltages over the electron emission threshold, the emission current also varies according to change in the voltage applied to the device. It is seen from this fact that when pulses of the voltage are applied to the present devices, no electron emission occurs with application of the voltage below the electron emission threshold, but the electron beams are outputted with application of the voltage over the electron emission threshold, for example. On that occasion, the intensity of output electron beam can be controlled by changing the peak value Vm of the pulses. It is also possible to control a total amount of charge of the output electron beam by changing the width Pw of the pulses. Accordingly, the voltage modulation method, the pulse width modulation method, or the like can be employed as a method for modulating the electron-emitting devices according to the input signal.

For carrying out the voltage modulation method, the modulation signal generator 127 can be a circuit of the voltage modulation method for generating voltage pulses of a constant length and properly modulating peak values of the pulses according to input data.

For carrying out the pulse width modulation method, the modulation signal generator 127 can be a circuit of the pulse width modulation method for generating voltage pulses of a constant peak value and properly modulating widths of the voltage pulses according to the input data.

The shift register 124 and the line memory 125 can be of either the digital signal type or the analog signal type. The point is that the serial/parallel conversion and storage of image signal should be carried out at a predetermined rate.

For use of the digital signal type, the output signal DATA of the synchronous signal separator 126 needs to be digitized. For this purpose, the output section of the synchronous signal separator 126 is provided with an A/D converter. In connection with it, the circuit used in the modulation signal generator 127 will slightly differ depending upon whether the output signals of the line memory 125 are digital signals or analog signals. In the case of the voltage modulation method using digital signals, the modulation signal generator 127 is, for example, a D/A converter and an amplifier is added if necessary. In the case of the pulse width modulation method, the modulation signal generator 127 is a circuit, for example, comprised of a high-speed oscillator, a counter for counting waves outputted from the oscillator, and a comparator for comparing an output value of the counter with an output value of the memory. The circuit may also be provided with an amplifier for amplifying the voltage of the modulation signal modulated in the pulse width from the comparator to the driving voltage of the surface conduction electron-emitting devices, if necessary.

In the case of the voltage modulation method using analog signals, the modulation signal generator 127 can be an amplifying circuit, for example, using an operational amplifier and may also be provided with a level shift circuit if necessary. In the case of the pulse width modulation method, a voltage-controlled oscillator (VCO) can be employed, for example, and it can also be provided with an amplifier for amplifying the voltage to the driving voltage of the surface conduction electron-emitting devices, if necessary.

In the image-forming apparatus to which the present invention can be applied and which can be constructed as described above, electron emission occurs when the voltage is applied through the terminals Dox1 to Doxm, Doy1 to Doyn outside the container to each electron-emitting device. The electron beams are accelerated by applying the high voltage through the high voltage terminal Hv to the metal back 105 or to the transparent electrode (not illustrated). The electrons thus accelerated collide with the fluorescent film 104 to bring about luminescence, thus forming the image.

It should be noted that the structure of the image-forming apparatus stated herein is just an example of the image-forming apparatus to which the present invention can be applied, and it can involve a variety of modifications based on the technological thought of the present invention. Although the NTSC method was exemplified for the input signals, the input signals can be of the PAL method, the SECAM method, or the like, or a method of TV signals including more scanning lines (for example, one of high-definition TV methods including the MUSE method) without having to be limited to the NTSC method.

The image-forming apparatus of the present invention can be applied to the display devices for television broadcasting system, the display devices for television conference systems, computers, and so on, image-forming apparatus as an optical printer constructed using a photosensitive drum etc., and so on.

EXAMPLES

The present invention will be described in further detail with examples thereof.

Example 1

The basic structure of the surface conduction electron-emitting device in the present example is the same as that illustrated in the plan view and sectional view of FIG. 1A and FIG. 1B and in the enlarged plan view and sectional view of FIG. 2A and FIG. 2B.

The production method of the surface conduction electron-emitting device in the present example is fundamentally the same as that illustrated in FIGS. 5A to 5D. The basic structure and production method of the device according to the present example will be described referring to FIGS. 1A, 1B, FIGS. 2A to 2D, and FIGS. 5A to 5D.

The production method will be described in order referring to FIGS. 1A, 1B, FIGS. 2A to 2D, and FIGS. 5A to 5D.

(Step-a)

First, nickel was deposited on a cleaned quartz substrate 1 by electron beam deposition. At this time the thickness was monitored using a quartz oscillator and the deposition was carried out under such conditions as to achieve the thickness of 1 nm. This film was observed under a scanning electron microscope and was found to be the island-shaped film as shown in FIG. 3B, in which fine particles having the particle size of about 2 nm were distributed in the coverage of about 40 to 50%. The sheet resistance Rs of this film was tried to be measured by an apparatus capable of measurement up to 1 MΩ/□, but it was unmeasurable. It was thus found that the film had the sheet resistance of at least 1 MΩ/□.

Then the substrate 1 with the nickel fine particle film formed thereon was baked at 500° C. in the atmosphere for thirty minutes to oxidize the film, and it was observed under the scanning electron microscope. From the observation, the film had the same form of fine particle film as the film before baking. To make sure, the sheet resistance Rs of this film was tried to measure, but it was also unmeasurable. It was thus found that the film had the sheet resistance of at least 1 MΩ/□.

In this way the metallic oxide film 6 of the fine particle film was formed on the substrate 1 (FIG. 5A).

For making the effect of the present invention clearer, a surface conduction electron-emitting device was fabricated through the same steps hereinafter as in the present example, on a quartz substrate without formation of the aforementioned metallic oxide film 6 and was defined as a reference example.

(Step-b)

On the substrate 1 with the metallic oxide film 6 formed thereon, a pattern to become the device electrodes 2, 3 and the desired device electrode gap L was formed with a photoresist (RD-2000N available from Hitachi Kasei K.K.) and then Ti and Ni were successively deposited in the thickness 5 nm and in the thickness 100 nm, respectively, by electron beam evaporation. The photoresist pattern was dissolved with an organic solvent, and the Ni/Ti deposit film underwent lift-off, thus forming the device electrodes 2, 3 having the device electrode gap L of 3 μm and the width W of the device electrodes of 300 μm (FIG. 5B).

(Step-c)

A Cr film was deposited in the thickness 100 nm by vacuum deposition and was patterned so as to form an aperture corresponding to the shape of the conductive film described hereinafter. An organic palladium compound solution (ccp4230 available from Okuno Seiyaku K.K.) was applied onto the film by spin coating with a spinner and it was baked at 300° C. for twelve minutes. The conductive film 4 having the principal component of fine particles of palladium oxide, thus made, had the thickness of 10 nm and the sheet resistance Rs of $2\times10^4$ MΩ/□. The fine particle film stated herein is a film as an assemblage of plural fine particles, as described previously.

(Step-d)

The Cr film, and the conductive film 4 after baked were etched with an acid etchant, thereby forming the conductive film 4 in the desired pattern (FIG. 5C).

According to the above steps, the metallic oxide film 6, device electrodes 2, 3, and conductive film 4 were formed on the substrate 1.

(Step-e)

Then the substrate with the films was set in the measuring and evaluating apparatus of FIG. 6 and the inside was evacuated by a vacuum pump. After the pressure reached the vacuum level of $1\times10^{-8}$ Torr, the voltage was placed between the device electrodes 2, 3 of the device from the power supply 61 for applying the device voltage Vf to the device, thus carrying out the forming operation. The voltage waveform of the forming operation was that shown in FIG. 7B.

In FIG. 7B, T1 and T2 indicate the pulse width and pulse separation of the voltage waveform. In the present example, the forming operation was carried out under such conditions that T1 was 1 msec, T2 was 10 msec, and the peak values of the rectangular waves were increased in steps of 0.1 V. During the forming operation a resistance measuring pulse at the voltage of 0.1 V was also interposed between the pulses for forming and the resistance was measured thereby. The end of the forming operation was determined to be the time when a measured value by the resistance measuring pulse became not less than about 1 MΩ and, at the same time, application of the voltage to the device was terminated.

(Step-f)

Figure 13:
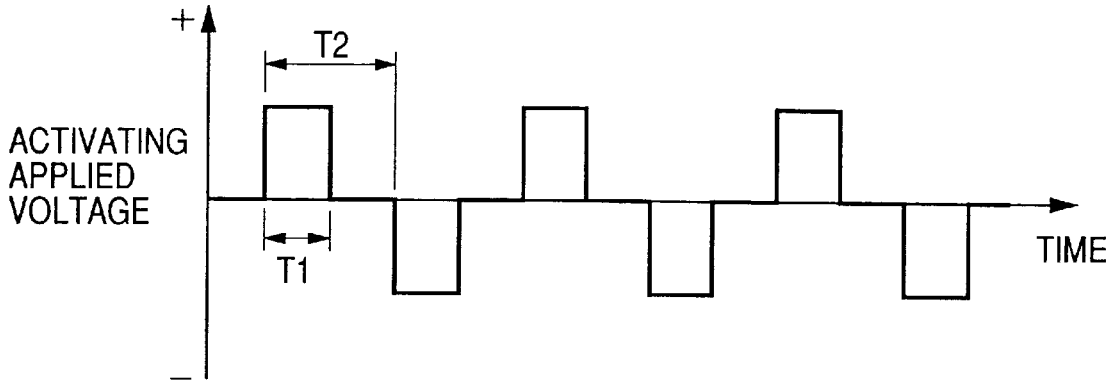
FIG. 13 is a drawing to show the shape of activation pulses suitable for the present invention.

For carrying out the activation step, benzonitrile was then introduced through a slow leak valve into the vacuum apparatus, so as to maintain the pressure at $1.0\times10^{-6}$ Torr. Then the device having underwent the forming operation was subjected to the activation operation by the waveform shown in FIG. 13 and having the peak value of 14 V. Specifically, the pulse voltage was placed between the device electrodes with measuring the device current If in the measuring and evaluating device. The If values were almost saturated after about fifteen minutes. Thus, energization was stopped and the slow leak valve was closed, thus ending the activation operation.

When the same activation step was carried out on the device of the reference example without formation of the metallic oxide film 6, approximately thirty minutes were necessitated before the If values were almost saturated.

As described above, the device of the present example required the shorter activation time than the device of the reference example did.

(Step-g)

Subsequently, the stabilization step was carried out. The vacuum apparatus and electron-emitting device were heated by heater and evacuation of the inside of the vacuum apparatus was carried on with maintaining the temperature at about 250° C. The heating by heater was stopped after 20 hours and the temperature was decreased to room temperature. The pressure inside the vacuum apparatus at that time was approximately $5\times10^{-10}$ Torr.

Then the electron emission characteristics were measured.

The distance H between the anode electrode 64 and the electron-emitting device was set to 4 mm and the voltage of 1 kV was supplied from the high-voltage supply 63 to the anode electrode 64. In this state the rectangular pulse voltage with the peak value of 14 V was applied between the device electrodes 2, 3 by use of the power supply 61, and the device current If and emission current Ie were measured for each of the device of the present example and the device of the reference example by use of the current meter 60 and current meter 62.

The device of the present example showed the following values; device current If=7.0 mA, emission current Ie=17.5 μA, and electron emission efficiency η(=Ie/If)=0.25%. The device of the reference example showed the following values: device current If=4.0 mA, emission current Ie=8 μA, and electron emission efficiency η(=Ie/If)=0.20%.

After this, the electron emission was further carried on, and the device current If and emission current Ie were again measured after a certain time had elapsed. At that point, the device of the present example showed no change: device current If=7.0 mA, emission current Ie=17.5 μA, and electron emission efficiency η (=Ie/If)=0.25%, whereas the device of the reference example showed the following values: device current If=2.5 mA, emission current Ie=5 μA, and electron emission efficiency η (=Ie/If)=0.20%.

This result verified that the device of the present example was more excellent not only in the emission current Ie and the electron emission efficiency η but also in the stability than the device of the reference example.

Observation under the electron microscope and element analysis were conducted for the device of the present example produced according to the above steps and for the device of the reference example.

First, a plane including the electron-emitting region 5 of the devices was observed under the scanning electron microscope. The shape of the plane of the device of the present example was similar to FIG. 2A, wherein the deposit is provided at an inner side of the gap 10 of the conductive film 4 in the vicinity of the gap 10. Specifically, the deposit was present on both sides of the gap portion formed in the conductive film, and this deposit was observed in the vicinity of the gap portion formed in the conductive film 4, i.e., across the almost all area of the electron-emitting section 5 formed in the conductive film 4. On the other hand, in the device of the reference example there were observed regions where the deposit was present on both sides of the gap formed in the conductive film 4, as in the case of the device of the present example, but there were also observed some regions without the deposit. Further, in the device according to the present invention, in the deposit 21 within the gap 10 formed at a part of the conductive film 4, a gap 22 of which width is narrower than the gap 10 was observed.

Next, the deposit near the gap of the conductive film 4 of the device of the present example and the device of the reference example was subjected to the element analysis by electron probe microanalysis (EPMA), X-ray photoelectron spectroscopy (XPS), and Auger electron spectroscopy. It was confirmed by the element analysis that the deposit contained the principal component of carbon.

Further, a cross section including the electron-emitting region 5 and deposit of each device was observed with a transmission electron microscope. The device of the reference example was observed by carefully selecting the regions with the deposit observed in the observation of the plane shape under the scanning electron microscope.

As a result, the deposit was the same as the shape shown in FIG. 2B, within the gap of the conductive film 4 of the device of the present example, and a lattice fringe image indicating the orientation of the layer structure parallel to the substrate surface was observed in the deposit. From measurement of the deposit by electron beam diffraction, the lattice spacing was about 3.4 Å. Subjecting to element analysis according to Energy-Dispersed X-ray Analysis a section in the vicinity of an interface between the deposit and the substrate, it was observed that Ni element exists at a surface of the substrate to which the deposit contacts. On the other hand, the deposit was also present also within the gap of the conductive film 4 of the device of the reference example, though the orientation was disturbed as compared with the device of the present example. From the measurement of this deposit by electron beam diffraction, the lattice spacing was about 3.8 Å.

The lattice spacing of the c plane of graphite is about 3.35 Å. Therefore, the value obtained from the deposit of the device of the present example is close to this value. It is thus understood that this result indicates that the deposit is made mainly of graphite-like carbon with good crystallinity. On the other hand, the lattice spacing of the deposit of the device of the reference example is considerably larger than the above value, and it is considered that this reflects poor crystallinity and disturbed structure.

It was proved from these observation results that in the device of the present example the carbon deposit in the gap of the conductive film 4 had good orientation and crystallinity and contributed to the stability of the electron emission characteristics.

It was also confirmed that the same effect was achieved when the metallic oxide film 6 was a film made of fine particles of cobalt oxide or iron oxide, as in the case of nickel oxide described above.

As described above, stable electron emission was achieved with good characteristics in the present example.

Example 2

In the present example, the basic structure of the surface conduction electron-emitting device is also the same as that in the plan view and sectional view of FIG. 1A and FIG. 1B and in the enlarged plan view and sectional view of FIG. 2A and FIG. 2B.

The production method of the surface conduction electron-emitting device according to the present example is also basically the same as that in FIGS. 5A to 5D. The basic structure and production method of the device according to the present example will be described referring to FIGS. 1A, 1B, FIGS. 2A to 2D, and FIGS. 5A to 5D.

The production method will be described in order referring to FIGS. 1A, 1B, FIGS. 2A to 2D, and FIGS. 5A to 5D.

(Step-a)

First, a cobalt oxide coating material and a silicon oxide coating material available from SYMETRIX Inc. were mixed and the composition of the mixture was preliminarily adjusted so that a component rate of cobalt oxide after baking became 50 mol %. The solution thus prepared was applied onto a soda lime glass substrate 1 after cleaned, by spin coating and this substrate was dried at 120° C. for thirty minutes. Thereafter, the substrate was prebaked at 470° C. for thirty minutes and fully baked at 550° C. for sixty minutes, thereby forming the film 6 containing the metallic oxide in the thickness of about 80 nm (FIG. 5A). The sheet resistance Rs of the film 6 containing the metallic oxide was tried to measure by the device capable of measurement up to 1 MΩ/□, but it was unmeasurable. It was thus seen that the film had the sheet resistance of at least 1 MΩ/□.

For making the effect of the present invention clearer, a surface conduction electron-emitting device was also fabricated through the same steps hereinafter as in the present example, on a soda lime glass substrate in which the layer corresponding to the above film 6 containing the metallic oxide, was made of silicon oxide 100%, and the device was defined as a reference example.

(Step-b)

On the substrate 1 with the film 6 containing the metallic oxide, formed thereon, a pattern to become the device electrodes 2, 3 and the desired device electrode gap L was formed with a photoresist (RD-2000N available from Hitachi Kasei K.K.) and then Ti and Ni were successively deposited in the thickness 5 nm and in the thickness 100 nm, respectively, by electron beam deposition. The photoresist pattern was dissolved with an organic solvent, and the Ni/Ti deposit film underwent lift-off, thus forming the device electrodes 2, 3 having the device electrode gap L of 3 μm and the width W of the device electrodes of 300 μm (FIG. 5B).

(Step-c)

A Cr film was deposited in the thickness 100 nm by vacuum deposition and was patterned so as to form an aperture corresponding to the shape of the conductive film described hereinafter. An organic palladium compound solution (ccp4230 available from Okuno Seiyaku K.K.) was applied onto the film by spin coating with a spinner and it was baked at 300° C. for twelve minutes. The conductive film 4 having the principal component of fine particles of palladium oxide, thus made, had the thickness of 10 nm and the sheet resistance of $2\times10^4$ MΩ/□. The fine particle film stated herein is a film as an assemblage of plural fine particles, as described previously.

(Step-d)

The Cr film, and the conductive film 4 after baked were etched with an acid etchant, thereby forming the conductive film 4 in the desired pattern (FIG. 5C).

According to the above steps, the film 6 containing the metallic oxide, device electrodes 2, 3, and conductive film 4 were formed on the substrate 1.

(Step-e)

Then the substrate with the films was set in the measuring and evaluating apparatus of FIG. 6 and the inside was evacuated by a vacuum pump. After the pressure reached the vacuum level of $1\times10^{-8}$ Torr, the voltage was placed between the device electrodes 2, 3 of the device from the power supply 61 for applying the device voltage Vf to the device, thus carrying out the forming operation. The voltage waveform of the forming operation was that shown in FIG. 7B.

In FIG. 7B, T1 and T2 indicate the pulse width and pulse separation of the voltage waveform. In the present example, the forming operation was carried out under such conditions that T1 was 1 msec, T2 was 10 msec, and the peak values of the rectangular waves were increased in steps of 0.1 V. During the forming operation a resistance measuring pulse at the voltage of 0.1 V was also interposed between the pulses for forming and the resistance was measured thereby. The end of the forming operation was determined to be the time when a measured value by the resistance measuring pulse became not less than about 1 MΩ and, at the same time, application of the voltage to the device was terminated.

(Step-f)

For carrying out the activation step, benzonitrile was then introduced through a slow leak valve into the vacuum apparatus, so as to maintain the pressure at $1.0\times10^{-6}$ Torr. Then the device having underwent the forming operation was subjected to the activation operation by the waveform shown in FIG. 13 and having the peak value of 14 V. Specifically, the pulse voltage was placed between the device electrodes with measuring the device current If in the measuring and evaluating device. The If values were almost saturated after about fifteen minutes. Thus, energization was stopped and the slow leak valve was closed, thus ending the activation operation.

When the same activation step was carried out on the device of the reference example wherein the above film 6 was made of only silicon oxide, approximately thirty minutes were necessitated before the If values were almost saturated.

As described above, the device of the present example required the shorter activation time than the device of the reference example did.

(Step-g)

Subsequently, the stabilization step was carried out. The vacuum apparatus and electron-emitting device were heated by heater and evacuation of the inside of the vacuum apparatus was carried on with maintaining the temperature at about 250° C. The heating by heater was stopped after 20 hours and the temperature was decreased to room temperature. The pressure inside the vacuum apparatus at that time was approximately $5\times10^{-10}$ Torr.

Then the electron emission characteristics were measured by the same method as in Example 1.

The device of the present example showed the following values; device current If=5.0 mA, emission current Ie=12.5

μA, and electron emission efficiency η (=Ie/If)=0.25%. The device of the reference example showed the following values: device current If=3.5 mA, emission current Ie=7 μA, and electron emission efficiency η (=Ie/If)=0.20%.

After this, the electron emission was further carried on, and the device current If and emission current Ie were again measured after a certain time had elapsed. At that point, the device of the present example showed no change: device current If=5.0 mA, emission current Ie=12.5 μA, and electron emission efficiency η (=Ie/If)=0.25%, whereas the device of the reference example showed the following values: device current If=2.0 mA, emission current Ie=4 μA, and electron emission efficiency η (=Ie/If)=0.20%.

This result verified that the device of the present example was also more excellent not only in the emission current Ie and the electron emission efficiency n but also in the stability than the device of the reference example.

Observation under the electron microscope was also conducted for the device of the present example and for the device of the reference example. In the device of the present example, the groove 7 as shown in FIGS. 2C and 2D was formed in part of the film 6 containing the metallic oxide immediately below the electron-emitting region 5. The deposit in the gap of the conductive film 4 was also observed in the same manner as in Example 1. It was verified from the observation that carbon with better orientation and crystallinity was deposited in the device of the present example than in the device of the reference example and contributed to enhancement and stability of the electron emission characteristics.

It was also confirmed that the same effect was achieved when the film 6 containing the metallic oxide was the film layer containing nickel oxide or iron oxide instead of cobalt oxide stated above.

As described above, stable electron emission was also achieved with good characteristics in the present example, as in the case of Example 1.

Example 3

The present example is an example of the image-forming apparatus in which a lot of surface conduction electron-emitting devices are arrayed in the simple matrix configuration.

Figure 14:
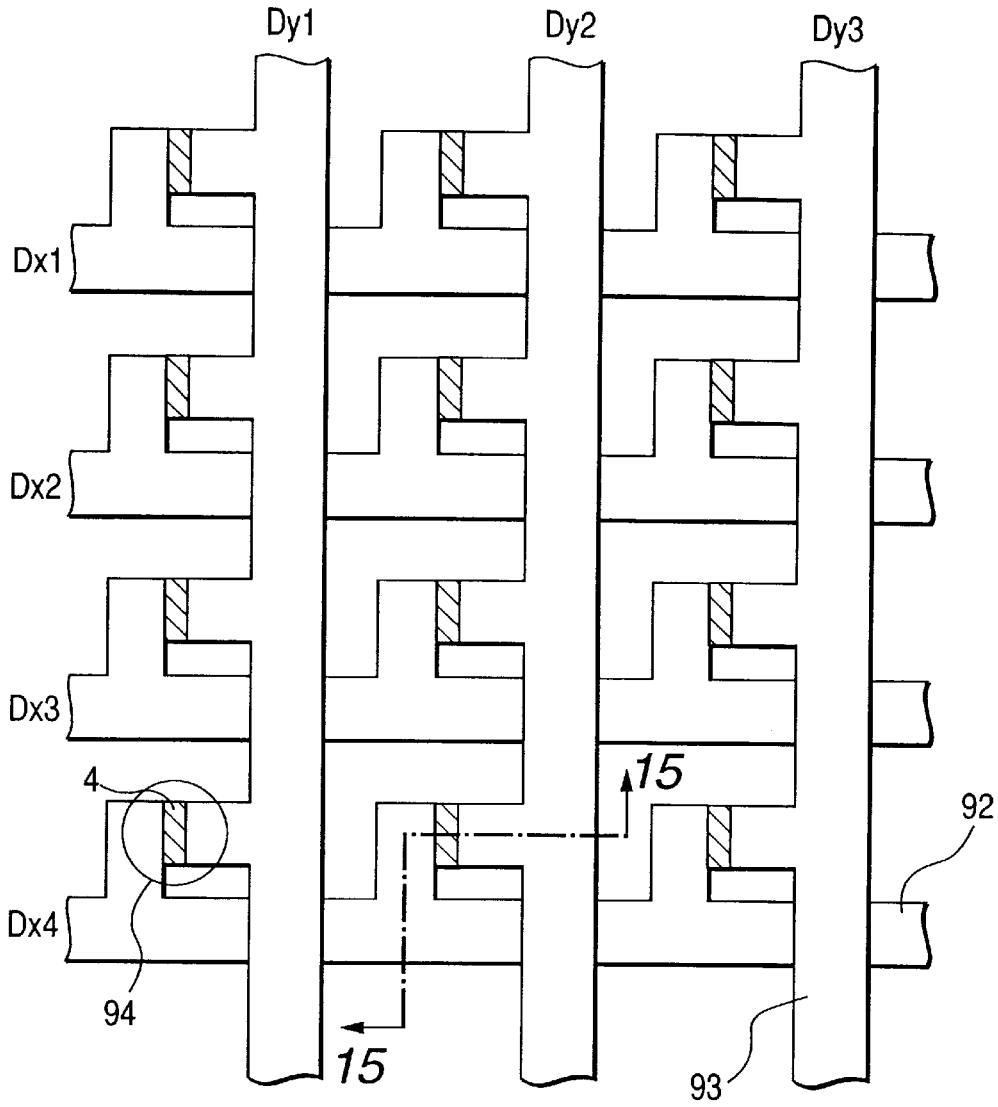
FIG. 14 is a drawing to show a part of the structure of an electron source in Example 2 of the present invention.
Figure 15:
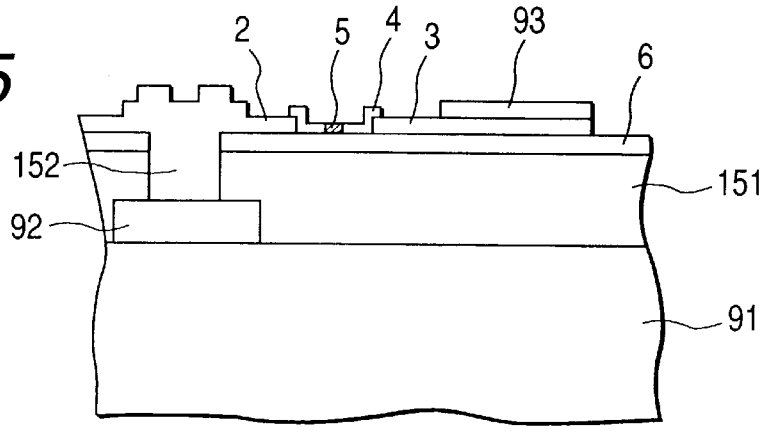
FIG. 15 is a sectional view of FIG. 14.

A plan view of a part of the electron source is illustrated in FIG. 14. A sectional view along 15—15 of FIG. 14 is illustrated in FIG. 15. In FIG. 14 and FIG. 15 the same symbols denote the same elements. Numeral 91 designates the substrate, 92 the X-directional wires (also called lower wires) corresponding to DXm of FIG. 9, 93 the Y-directional wires (also called upper wires) corresponding to DYn of FIG. 9, 4 the conductive film, 2, 3 the device electrodes, 6 the metallic oxide film, 151 the interlayer insulation layer, and 152 a contact hole for electrical connection between the device electrode 2 and the lower wire 92.

The production method will be described in detail according to the sequence of steps by reference to FIGS. 16A to 16D and FIGS. 17A to 17D.

(Step-a)

Figure 16A:
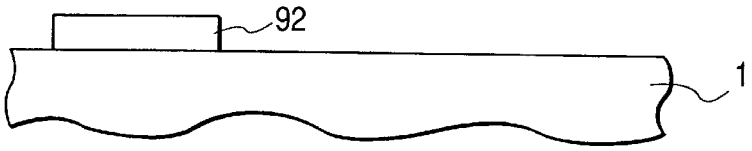
FIG. 16A, FIG. 16B, FIG. 16C, and FIG. 16D are sectional views for explaining production steps of the electron source in Example 2 of the present invention.

On the substrate 1 in which a silicon oxide film 0.5 mm thick was deposited by sputtering on a soda lime glass sheet after cleaned, Cr and Au were successively deposited in the thickness of 5 nm and in the thickness of 0.6 mm, respectively, by vacuum deposition and thereafter a photoresist (AZ1370 available from Heochst Inc.) was applied by spin coating with a spinner. Then the photoresist was baked and a photomask image was exposed and developed to form a resist pattern of the lower wires 92. Then the Au/Cr deposit film was wet-etched, thereby forming the lower wires 92 in the desired shape (FIG. 16A).

(Step-b)

Figure 16B:
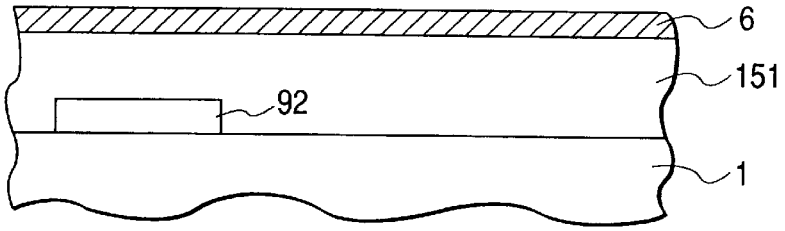

Then the interlayer insulation layer 151 of a silicon oxide film was deposited in the thickness of 1.0 μm by RF sputtering. Further formed on the interlayer insulation layer 151 by co-sputtering of two species was the film 6 containing the metallic oxide in the thickness of about 100 nm wherein component rates of nickel oxide and silicon oxide were 50 mol % each (FIG. 16B). The two-species co-sputtering method is carried out, for example, by using a composite target in which different targets of two kinds ($SiO_2$ and NiO in this case) are coupled, or by using two targets respectively having an RF power supply. This example employed the former method, but it is of course possible to employ the latter method.

(Step-c)

Figure 16C:
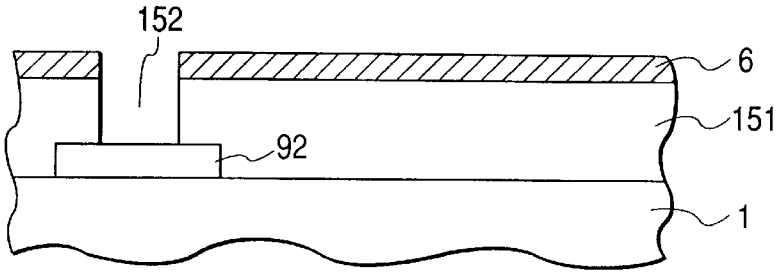

A photoresist pattern for formation of the contact holes 152 was made on the interlayer insulation layer 151 and the film 6 containing the metallic oxide, having been deposited in the step-b. Using this pattern as a mask, the interlayer insulation film 151 and the film 6 containing the metallic oxide were etched to form the contact holes 152 therein (FIG. 16C).

(Step-d)

Figure 16D:
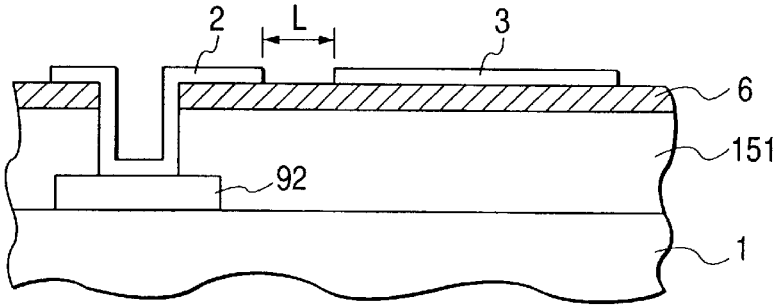

After that, a pattern to become the device electrode 2 and the device electrode gap L was formed with a photoresist (RD-2000N available from Hitachi Kasei K.K.) and then Ti and Ni were successively deposited thereon in the thickness 5 nm and in the thickness 0.1 mm, respectively, by vacuum evaporation. The photoresist pattern was then dissolved with an organic solvent and the Ni/Ti deposit film was subjected to lift-off, thereby forming the device electrodes 2, 3 having the device electrode gap L=3 μm and the width W of device electrodes=0.3 mm (FIG. 16D).

(Step-e)

Figure 17A:
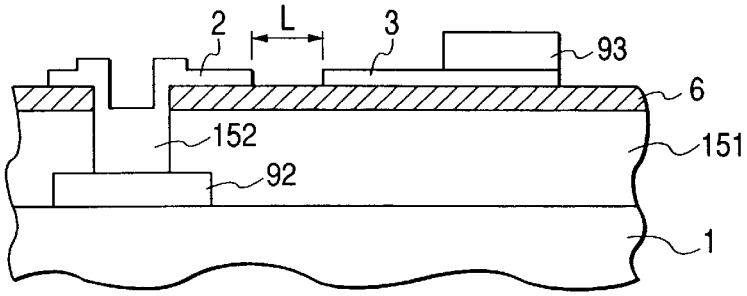
FIG. 17A, FIG. 17B, FIG. 17C, and FIG. 17D are sectional views for explaining production steps of the electron source in Example 2 of the present invention.

A photoresist pattern for the upper wires 93 was formed on the device electrodes 2, 3 and thereafter Ti and Au were successively deposited thereon in the thickness 5 nm and in the thickness 0.5 mm, respectively, by vacuum deposition. Then unnecessary portions were removed by lift-off, thus forming the upper wires 93 in the desired shape (FIG. 17A).

(Step-f)

Figure 17B:
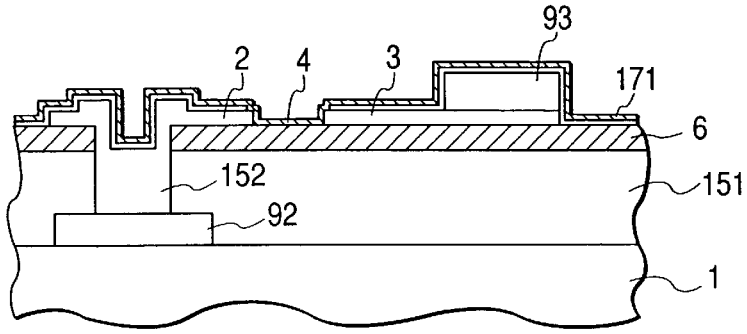

The Cr film 171 0.1 mm thick was deposited by vacuum deposition and patterned, an organic palladium compound solution (ccp4230 available from Okuno Seiyaku K.K.) was applied thereonto by spin coating with a spinner, and it was baked at 300° C. for ten minutes (FIG. 17B). The conductive film 4 mainly containing the fine particles of palladium oxide, thus formed, had the thickness of 10 nm and the sheet resistance of $2\times10^4$ Ω/□.

(Step-g)

Figure 17C:
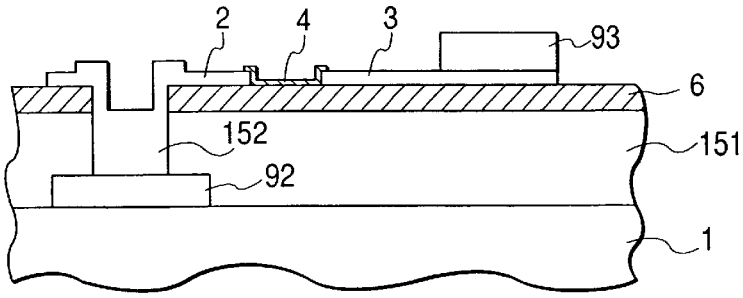

The Cr film 171, and the conductive film 4 after the baking were etched with an acid etchant and subjected to lift-off, thereby forming the conductive film 4 in the desired pattern (FIG. 17C).

(Step-h)

Figure 17D:
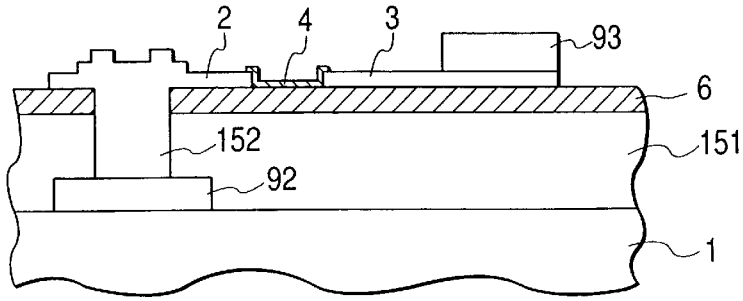
Figure 18:
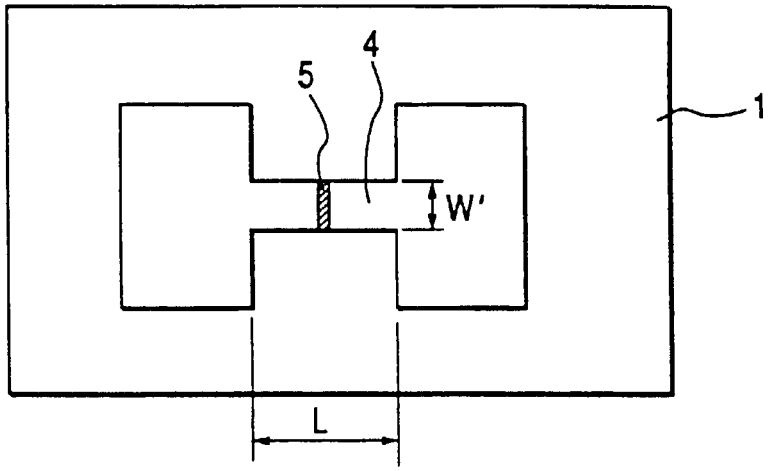
FIG. 18 PRIOR ART
FIG. 18 is a drawing to show the structure of the conventional surface conduction electron-emitting device.

A pattern was formed so as to coat the other portions than the portions of contact holes 152 with a resist, and then Ti and Au were successively deposited thereon in the thickness 5 nm and in the thickness 0.5 mm, respectively, by vacuum deposition. Then unnecessary portions were removed by lift-off, thereby filling the contact holes 152 (FIG. 17D).

According to the above steps, the lower wires 92, the interlayer insulation layer 151, the film 6 containing the metallic oxide, the upper wires 93, the device electrodes 2, 3 and the conductive film 4 were formed on the insulative substrate 1.

Figure 9:
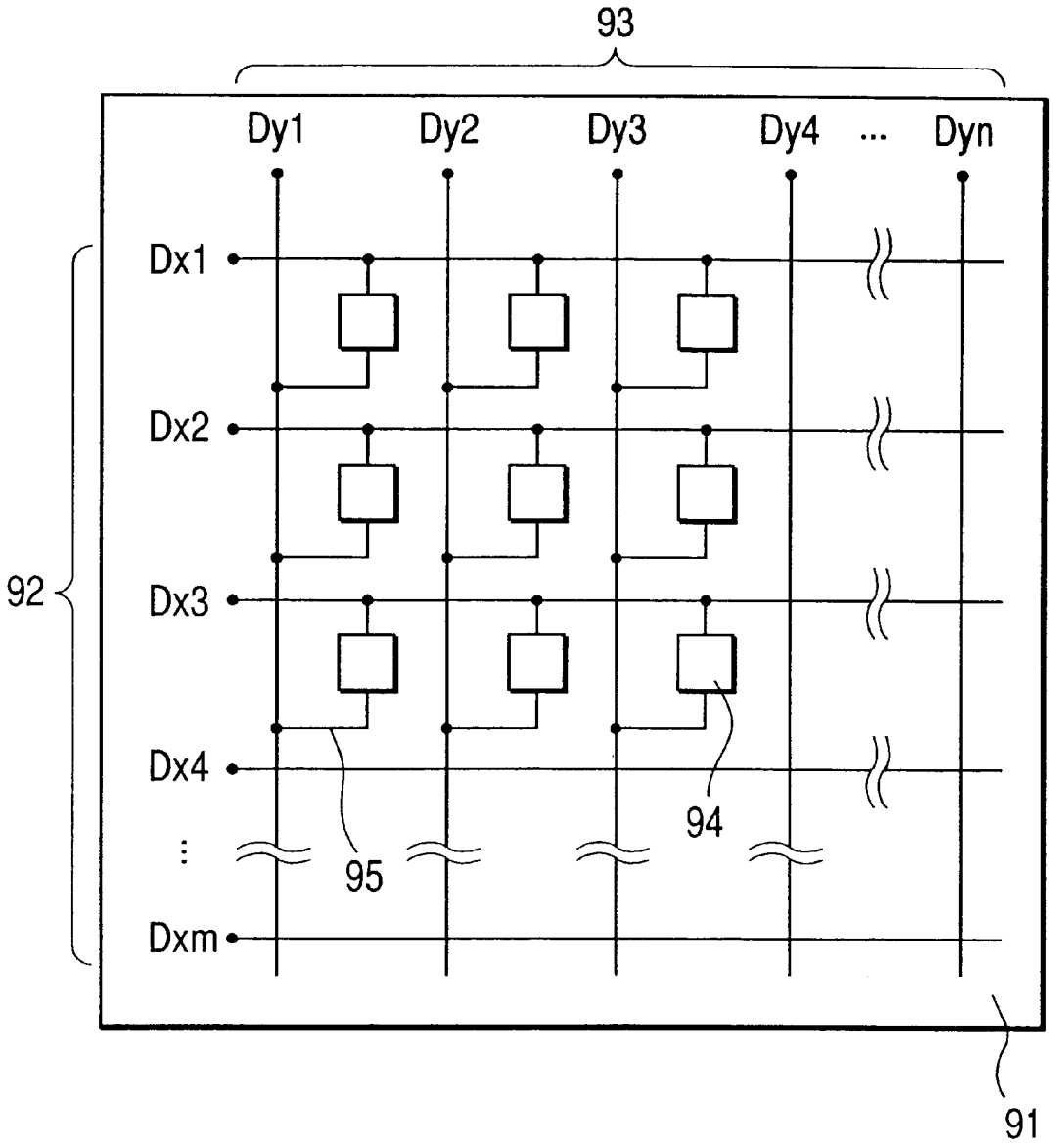
FIG. 9 is a diagram to show the structure of an electron source substrate according to the present invention.

Next described referring to FIG. 9 and FIG. 10 is an example of construction of an electron source and a display device using the electron source substrate produced as described above.

The substrate 1 having the devices fabricated as described above thereon was fixed on the rear plate 101, and the face plate 106 (in which the fluorescent film 104 and metal back 105 were formed on the inner surface of glass substrate 103) was placed thereon through the support frame 102. Frit glass was applied to joint parts between the face plate 106, the support frame 102, and the rear plate 101 and was baked at 400° C. in the atmosphere for ten minutes, thereby effecting sealing thereof. The fixing of the substrate 1 to the rear plate 101 was also conducted with the frit glass.

In the present example numeral 94 of FIG. 10 denotes the surface conduction electron-emitting devices in which the electron-emitting region was formed in the aforementioned conductive film 4 by the method described hereinafter (for example, corresponding to FIGS. 1A and 1B), and numerals 92, 93 the device wires in the X-direction and in the Y-direction, respectively.

The fluorescent film 104 is comprised of only a fluorescent member in the monochrome case, but the fluorescent film 104 of the present example was produced by employing the stripe shape of fluorescent members, first forming the black stripes, and then coating gap portions between them with the fluorescent members of the respective colors. The material for the black stripes was a material whose principal component was graphite commonly widely used. A method for coating the glass substrate 103 with the fluorescent members was a slurry method.

The metal back 105 is normally provided on the inner surface side of the fluorescent film 104. The metal back was made after fabrication of the fluorescent film by carrying out a smoothing operation (normally called filming) of the internal surface of the fluorescent film and thereafter depositing Al thereon by vacuum deposition.

In certain cases the face plate 106 is provided with a transparent electrode (not illustrated) on the outer surface side of the fluorescent film 104 in order to enhance the electrical conduction property of the fluorescent film 104. However, the present example achieved the sufficient electric conduction property by only the metal back, and thus the transparent electrode was not provided.

On the occasion of the aforementioned sealing, sufficient position alignment was conducted in order to achieve correspondence between the electron-emitting devices and the fluorescent members of the respective colors in the color case.

The ambience in the glass container completed as described above was evacuated through an exhaust pipe (not illustrated) by a vacuum pump. After a sufficient vacuum degree was accomplished, the forming operation of the conductive film 4 described above was carried out by applying the voltage between the aforementioned device electrodes 2, 3 through the external terminals Dox1–Doxm and Doy1–Doyn. The voltage waveform of the forming operation was the same as that shown in FIG. 7B.

In the present example the forming operation was carried out under a vacuum ambience of about $1\times10^{-5}$ Torr with T1 of 1 msec and T2 of 10 msec.

Then evacuation was carried on before the pressure in the panel reached the level of $10^{-8}$ Torr. Thereafter, benzonitrile was introduced through the exhaust pipe of the panel thereinto so that the total pressure became $1\times10^{-6}$ Torr. This state was maintained. The activation operation was then carried out by again applying the voltage in the waveform shown in FIG. 13 with the peak value of 14 V between the aforementioned device electrodes 2, 3 through the external terminals Dox1–Doxm and Doy1–Doyn.

The forming and activation operations were carried out as described above to form the electron-emitting region 5 in the aforementioned conductive film 4, thus producing a plurality of surface conduction electron-emitting devices 94.

Then the whole panel was evacuated with heating at 250° C. and the temperature was then decreased to room temperature. After the pressure was reduced to approximately $10^{-9}$ Torr, the exhaust pipe not illustrated was heated by a gas burner to be fused, thus effecting encapsulation of the envelope.

In the last step, in order to maintain the pressure after the encapsulation, a getter operation was carried out by high-frequency heating.

In the image displaying apparatus of the present invention completed as described above, the scanning signal and modulation signal were applied each by the unrepresented signal generating means to each electron-emitting device through the external terminals Dox1–Doxm, Doy1–Doyn, whereby the devices emitted electrons. The high voltage of not less than 5 kV was applied to the metal back 105 through the high-voltage terminal 107 to accelerate the electron beams and to make the beams collide with the fluorescent film 104, so as to bring about excitation and luminescence thereof, thereby displaying the image.

The image displaying apparatus in the present example was able to stably display good images with fully satisfactory luminance (about 150 fL) for TV application over long time.

Example 4

The present example is an example of displaying apparatus so constructed as to display image information provided from various image information sources including television broadcasting. The image-forming apparatus shown in FIG. 10 was driven by the driving circuit shown in FIG. 12 to achieve the display according to the TV signals of the NTSC method.

In the display apparatus of the present example, it is particularly easy to decrease the thickness of the display panel having the surface conduction electron-emitting devices as electron beam sources, and thus the depth of the display apparatus can be decreased. In addition, the display panel having the surface conduction electron-emitting devices as electron beam sources is readily formed in a large screen size, has high luminance, and is also excellent in visual field characteristics, so that the displaying apparatus of the present example can display. images of strong appeal with full presence and with good visibility.

The displaying apparatus in the present example was able to stably display good TV images according to the TV signals of the NTSC method over long time.

As detailed above, the present invention can enhance the orientation and crystallinity of the deposit containing the principal component of carbon by forming the metallic oxide film of nickel oxide or the like on the substrate surface and can provide the electron-emitting device capable of emitting the stable electron emission current over long time. In addition, the invention reduces the time for the forming step of the deposit containing the principal component of carbon and, as a result, the invention can decrease the production cost of the electron-emitting device and the electron source using it, and in turn the production cost of the image-forming apparatus.

Further, the electron source for emitting electrons according to the input signal can be constructed as an electron source in which a plurality of the aforementioned electron-emitting devices are arrayed on the substrate and the electron source can be constructed in the configuration in which there are a plurality of rows of the electron-emitting devices, the both ends of the individual devices being connected to wires, and in which the modulating means is provided, or in the configuration in which pairs of device electrodes of the electron-emitting devices are connected to the m X-directional wires and to the n Y-directional wires, the X-directional wires and the Y-directional wires being electrically insulated from each other, and in which a plurality of such electron-emitting devices are arrayed on the substrate, whereby a cheap electron source can be provided so that each electron-emitting device can maintain good electron emission characteristics over long time.

Since the image-forming apparatus is constructed of the image-forming member and the electron source and forms the image based on the input signal, stability of electron emission characteristics and increase in the lifetime are achieved. For example, in the case of the image-forming apparatus using the fluorescent members as the image-forming member, a high-definition image-forming apparatus, for example, a color flat television, can be realized.

What is claimed is:

1. An electron-emitting device comprising, a substrate, a pair of electrodes disposed on the substrate, an electroconductive film disposed on the substrate and having a gap in at least a portion thereof, the electroconductive film being connected to said pair of electrodes, and a member comprising carbon, said member being provided in the gap and being connected to the electroconductive film, wherein a metallic oxide comprising at least one element selected from the group consisting of nickel, iron, and cobalt is disposed between said member comprising carbon and said substrate, and said metallic oxide also is disposed between said electroconductive film and said substrate.

2. The electron-emitting device according to claim 1, wherein said electron-emitting device is a surface conduction electron-emitting device.

3. The electron-for emitting device according to claim 1, wherein said member comprises a principal component of carbon having a crystal lattice of a layer structure substantially parallel to a surface of the substrate.

4. An electron-emitting device comprising, a substrate, a pair of electrodes disposed on the substrate, an electroconductive film disposed on the substrate and having a gap in at least a portion thereof, said electroconductive film being connected to said pair of electrodes, a member comprising a principal component of carbon provided in the gap and being connected to the electroconductive film, and a metallic oxide comprising a least one element selected from the group consisting of nickel, iron, and cobalt, disposed between said member comprising the principal component of carbon and said substrate, wherein said metallic oxide is contained in a matrix containing a principal component of silica and is disposed between said member comprising the principal component of carbon and said substrate.

5. An electron source for emitting electrons according to an input signal, said electron source comprising a plurality of the electron-emitting devices, each having a construction as set forth in claim 1 or 4.

6. The electron source according to claim 5 wherein the plurality of electron-emitting devices are arranged in parallel, said electron source has plural rows of the electron-emitting devices, both ends of individual ones of the electron-emitting devices are connected to wires, and the electron source further comprises a modulator.

7. The electron source according to claim 5 wherein a pair of electrodes of each electron-emitting device is connected to one of m X-directional wires and to one of n Y-directional wires electrically insulated from said X-directional wires.

8. An image-forming apparatus for forming an image, based on an input signal, said image-forming apparatus comprising an image-forming member and the electron source set forth in claim 5.

9. A production method of an electron-emitting device, the method comprising a step of forming an electroconductive film on a film comprising a metallic oxide which includes at least one element selected from the group consisting of nickel, iron, and cobalt, provided between a pair of electrodes on a substrate, a step of forming a gap in at least a portion of the electroconductive film, and a step of forming a member comprising a principal component of carbon in a connected state to the electroconductive film in the gap.

10. The production method according to claim 9, wherein said step of forming the gap in at least a portion of the electroconductive film comprises a step of applying a voltage to said electroconductive film.

11. The production method according to claim 9, wherein said step of forming the member comprising the principal component of carbon comprises a step of applying a voltage to said electroconductive film in an ambient environment in which a carbon compound exists.

12. The production method according to claim 9, wherein said pair of electrodes are formed after formation of said film on said substrate.

13. The production method according to claim 9, wherein said metallic oxide is at least one oxide selected from the group consisting of nickel oxide, iron oxide, and cobalt oxide.

14. The production method according to claim 9, wherein said film is a film in which the metallic oxide is contained in a matrix containing a principal component of silica.

15. The production method according to claim 9, wherein said electron-emitting device is a surface conduction electron-emitting device.

* * * * *

UNITED STATES PATENT AND TRADEMARK OFFICE

CERTIFICATE OF CORRECTION

PATENT NO. : 6,586,872 B2
DATED : July 1, 2003
INVENTOR(S) : Masaaki Shibata

It is certified that error appears in the above-identified patent and that said Letters Patent is hereby corrected as shown below:

Column 5,
Line 5, "the at" should read -- at --.

Column 6,
Lines 10 and 12, "over" should read -- over a --.

Column 9,
Line 3, "lowers" should read -- lower --; and
Line 17, "-the" should read -- the --.

Column 10,
Line 7, "ten pm." should read -- ten μm. --.

Column 14,
Line 10, "for the" should read -- for --.

Column 15,
Line 34, "1printing," should read -- printing, --.

Column 17,
Line 28, "after" should read -- after being --.

Column 20,
Line 6, "data," should read -- data --.

Column 24,
Line 51, "also within" should read -- within --.

Column 25,
Line 30, "50 mol %." should read -- 50 mol%. --; and
Line 38, "to measure" should read -- to be measured --.

Column 27,
Line 16, "n" should read -- η --.

UNITED STATES PATENT AND TRADEMARK OFFICE

CERTIFICATE OF CORRECTION

PATENT NO. : 6,586,872 B2
DATED : July 1, 2003
INVENTOR(S) : Masaaki Shibata

It is certified that error appears in the above-identified patent and that said Letters Patent is hereby corrected as shown below:

Column 28,
Line 10, "50 mol %" should read -- 50 mol% --.

Column 30,
Line 51, "display." should read -- display --; and
Line 55, "over" should read -- over a --.

Column 31,
Line 17, "over" should read -- over a --; and
Line 43, "electron-for emitting" should read -- electron-emitting --.

Signed and Sealed this

Thirtieth Day of December, 2003

JAMES E. ROGAN
*Director of the United States Patent and Trademark Office*